US006477347B2

(12) United States Patent
Yokota et al.

(10) Patent No.: US 6,477,347 B2
(45) Date of Patent: Nov. 5, 2002

(54) IMAGE FORMATION APPARATUS USING LIQUID DEVELOPER AND COLLECTION OF SOLVENT VAPOR

(75) Inventors: Yasuhiro Yokota, Yokohama; Kenichi Takahara, Tokyo, both of (JP)

(73) Assignee: Kabushiki Kaisha Toshiba, Kawasaki (JP)

( * ) Notice: Subject to any disclaimer, the term of this patent is extended or adjusted under 35 U.S.C. 154(b) by 0 days.

(21) Appl. No.: 09/819,848

(22) Filed: Mar. 29, 2001

(65) Prior Publication Data

US 2001/0026696 A1 Oct. 4, 2001

(30) Foreign Application Priority Data

Mar. 30, 2000 (JP) ..... 2000-095527

(51) Int. Cl.[7] ..... G03G 15/10
(52) U.S. Cl. ..... 399/250
(58) Field of Search ..... 399/57, 249, 250, 399/251, 43

(56) References Cited

U.S. PATENT DOCUMENTS 4,733,272 A 3/1988 Howe et al.
4,760,423 A * 7/1988 Holtje et al. ..... 355/30
5,708,938 A * 1/1998 Takeuchi et al. ..... 399/250
5,878,305 A * 3/1999 Suzumura et al. ..... 399/237
6,101,356 A * 8/2000 Kim et al. ..... 347/89
6,289,192 B1 9/2001 Nukada et al.

FOREIGN PATENT DOCUMENTS

JP 48-82835 11/1973
JP 04077754 A * 3/1992 ..... G03G/15/00
JP 09329968 A * 12/1997 ..... G03G/15/10

* cited by examiner

*Primary Examiner*—Robert Beatty
(74) *Attorney, Agent, or Firm*—Oblon, Spivak, McClelland, Maier & Neustadt, P.C.

(57) ABSTRACT

An image formation apparatus includes a latent image carrier which is rotatable, a developing unit which supplies a liquid developer to the latent image carrier and develops a latent image formed on the latent image carrier, the liquid developer containing solvent and toner particles, a collecting unit which collects solvent vapor of the liquid developer, a separating unit which separates the solvent vapor from air collected by the collecting unit, a sensor which measures a density of solvent vapor in the separating unit, and a control unit which controls a rotational speed of the latent image carrier in accordance with the density of solvent vapor measured by the sensor or number of pages to be printed per unit time. A further embodiment includes two separating units and selecting between them in accordance with the density of solvent vapor or number of pages to be printed per unit time.

13 Claims, 16 Drawing Sheets

| PAGE NUMBERS / TIME | 10 OR LESS | 11 TO 50 | 51 TO 100 | · · · |
|---|---|---|---|---|
| SPEED | Vx | Vy | Vz | · · · |

| ELAPSED TIME FROM TERMINATION OF PRINTING | LESS THAN 3 MIN. | 3 MIN. OR MORE | | |
|---|---|---|---|---|
| PAGE NUMBERS / TIME | | 20 OR LESS | 21 TO 100 | · · · |
| OPERATING TIME | 10 SEC | 20 SEC | 30 SEC | · · · |

IMAGE FORMATION APPARATUS USING LIQUID DEVELOPER AND COLLECTION OF SOLVENT VAPOR

CROSS-REFERENCE TO RELATED APPLICATIONS

This application is based upon and claims the benefit of priority from the prior Japanese Patent Application No. 2000-095527, filed Mar. 30, 2000, the entire contents of which are incorporated herein by reference.

BACKGROUND OF THE INVENTION

The present invention relates to an image formation method and apparatus, and more specifically to an image formation method and apparatus which use a liquid developer and recover solvent vapor which is generated in evaporation of the liquid developer.

An image formation apparatus using a liquid developer has advantages over a dry type of image formation apparatus and its values have recently been recognized again. For example, the main advantages of the wet type of image formation apparatus over the dry type are: high image quality can be achieved since very small toner particles of submicron dimensions can be used; economy can be effected because even a small amount of toner is enough to obtain good image density and moreover the same level of texture as in printing (e.g., offset printing) can be provided; and energy saving can be effected since the toner can be fixed onto a paper at a relatively low temperature.

The conventional wet developing image formation technology involves some essential problems and have therefore allowed the dry developing technology to occupy the dominant position over a long time.

The problems with the wet developing technology are:

(1) To develop an electrostatic latent image, a high-resistivity or insulating petroleum solvent must be used as the carrier solvent in the liquid developer. There is the possibility that bad odor resulting from volatilization of the solvent and the volatilized solvent may produce allergic reactions in the human body.

(2) Not only toner but also a large quantity of solvent adheres to the electrostatic latent image in the development process, which requires a step of removing the excess solvent after development and a step of removing the toner suspended in the solvent. It is further required to collect and remove the solvent vapor volatilized in the air in all the steps including transfer and fixing ones.

(3) An environmental problem may arise from adhesion of the solvent to paper. In field transfer of the liquid developer, toner particles, or electrically charged particles are moved in the solvent by electrophoresis and then transferred to a paper. In the field transfer, therefore, there must exist a predetermined quantity of solvent between the latent image carrier and the paper. As a result, a large quantity of solvent will adhere to the paper after transfer. Part of the solvent volatilizes by heat in the fixing process and then escapes from the image formation apparatus. The resulting odor and vapor will adversely affect the human body. Also, there is the possibility that the paper ejected out of the apparatus after fixing may contain a large quantity of solvent. This may adversely affect the user who handles the paper.

To solve such problems, a method has been proposed by which temporal transfer is made from a latent image carrier to an intermediate transfer medium and transfer to paper is then made. In U.S. Pat. Nos. 5,148,222, 5,166,734, and 5,208,637 are disclosed methods that transfer an image from the latent image carrier to the intermediate transfer medium and then transfer the image to a paper by pressure (and heat).

Those proposed techniques do not suffer from the problems associated with the field transfer since transfer from the intermediate transfer medium to the paper is made by heat and pressure. In addition, the solvent adhered to the intermediate transfer medium can be vaporized or sucked by heating or air suction prior to the pressure transfer to paper. In this manner, the amount of solvent adhered to the paper can be reduced. Moreover, the pressure transfer to paper can be made with no solvent involved.

However, as the liquid developer, use is normally made of one which is composed of a petroleum insulating solvent and electrically charged particles (toner particles) dispersed in the solvent. When such a solvent is used, organic solvent vapor is produced by natural volatilization in all places in the image formation apparatus where the liquid developer is present. The production of the solvent vapor by volatilization cannot be prevented perfectly. Trying to remove the solvent in the liquid developer from the photosensitive drum, intermediate transfer roller, transfer roller, or paper by thermal vaporization will cause a substantial quantity of solvent vapor to be produced in the apparatus, so that the apparatus is filled inside with the solvent vapor.

In this case, from the aforementioned reasons it is not desirable to discharge air in the apparatus to outside. Accordingly, recovery of the solvent vapor is made within the apparatus. For example, in Japanese Patent Application KOKAI Publication No. 48-82835, the solvent vapor produced around the fixing section is sucked and liquefied for recovery. Even with the liquefaction by cooling, however, the vapor-recovering efficiency is poor since the density of the solvent vapor cannot be lowered to less than its saturated vapor pressure at a cooling temperature. Although the solvent vapor density has been lowered to the saturated vapor pressure, it is not desirable to discharge the solvent vapor from the apparatus as it is.

Even if solvent vapor recovery equipment, such as cooling liquefaction equipment, is installed, its recovering capacity will be exceeded in the event that solvent vapor is produced continuously as in continuous operation for a long time. In such a case, the solvent vapor density may increase.

When the interior of the apparatus has to be exposed to outside as in the case of maintenance or paper jam, high-density solvent vapor will be discharged. To prevent this, the solvent must be recovered in a more efficient manner.

BRIEF SUMMARY OF THE INVENTION

Accordingly, it is an object of the present invention to provide an image formation method and apparatus capable of efficiently suppressing the discharge of high-density solvent vapor from the apparatus.

According to one aspect of the present invention, there is provided an image formation apparatus comprising: a latent image carrier which is rotatable; a developing unit which supplies a liquid developer to the latent image carrier and develops a latent image formed on the latent image carrier, the liquid developer containing solvent and toner particles; a collecting unit which collects solvent vapor of the liquid developer; a separating unit which separates the solvent vapor from air collected by the collecting unit; a sensor which measures a density of solvent vapor in the separating unit; and a control unit which controls a rotational speed of the latent image carrier in accordance with the density of solvent vapor measured by the sensor.

According to another aspect of the present invention, there is provided an image formation apparatus comprising: a latent image carrier which is rotatable; a developing unit which supplies a liquid developer to the latent image carrier and develops a latent image formed on the latent image carrier, the liquid developer containing solvent and toner particles; a collecting unit which collects solvent vapor of the liquid developer; a separating unit which separates the solvent vapor from air collected by the collecting unit; and a control unit which controls a rotational speed of the latent image carrier on the basis of a number of pages to be printed per unit time.

According to still another aspect of the present invention, there is provided an image formation apparatus comprising: a latent image carrier which is rotatable; a developing unit which supplies a liquid developer to the latent image carrier and develops a latent image formed on the latent image carrier, the liquid developer containing solvent and toner particles; a collecting unit which collects solvent vapor of the liquid developer; first and second separating units which separate the solvent vapor from air collected by the collecting unit, the first and second separating units differing in their amount of solvent vapor to be separated per unit time; a control unit which selects one of the first and second separating units in accordance with variation of an amount of solvent vapor in one of the first and second separating units; and a restoration unit which restores a vapor-separating capacity of one of the first and second separating units, which separates larger amount of solvent vapor per unit time than the other.

According to still another aspect of the present invention, there is provided an image formation apparatus comprising: a latent image carrier which is rotatable; a developing unit which supplies a liquid developer to the latent image carrier and develops a latent image formed on the latent image carrier, the liquid developer containing solvent and toner particles; a collecting unit which collects solvent vapor of the liquid developer; first and second separating units which separate the solvent vapor from air collected by the collecting unit, the first and second separating units differing in their amount of solvent vapor to be separated per unit time; and a control unit which selects one of the first and second separating units on the basis of a number of pages to be printed per unit time.

DETAILED DESCRIPTION OF THE INVENTION

The embodiments of the present invention will be described below with reference to the drawings.

<First Embodiment>

Figure 1:
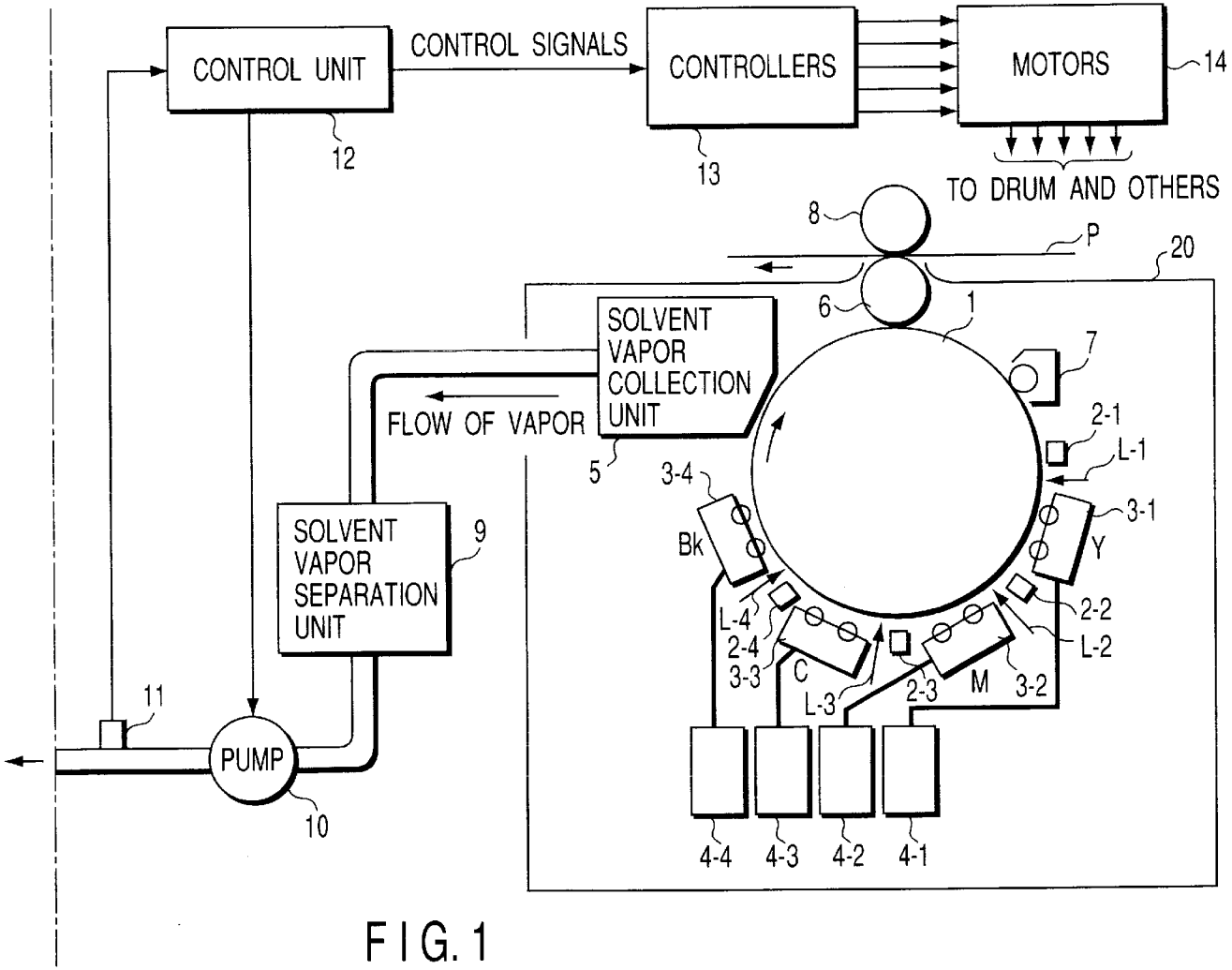
FIG. 1 is a schematic representation of an image formation apparatus according to a first embodiment of the present invention.

FIG. 1 shows the configuration of an image formation apparatus according to a first embodiment of the present invention.

The image formation apparatus is equipped with a photosensitive drum 1, or a latent image carrier in the form of a cylinder, which can be rotated in one direction by a driving motor. Around the photosensitive drum 1 are arranged corona electrical chargers 2-1, 2-2, 2-3 and 2-4, developing units 3-1, 3-2, 3-3 and 3-4 which contain a liquid developer to be supplied to the surface of the photosensitive drum, developer reservoirs 4-1, 4-2, 4-3 and 4-4 for storing the liquid developer, a solvent vapor collection unit 5 for evaporating the liquid developer adhered to the drum surface and collecting the resulting solvent vapor, an intermediate transfer roller 6 which is an image bearing body pressed against the drum surface, and a residual developer recovery unit 7 for recovering the residual developer on the drum surface.

The image formation apparatus is further provided with a fixing roller 8 placed apart from the intermediate transfer roller 6, a solvent vapor separating unit 9 for cooling and liquefying the solvent vapor collected by the solvent vapor collection unit 5 and separating and recovering the solvent, a pump 10 as a solvent vapor discharger for discharging the solvent vapor which cannot be recovered by the solvent vapor separation unit 9, a density sensor 11, provided in the pipe for discharging the vapor discharged from the unit 9 to the outside of the apparatus, for detecting the density of solvent vapor, a control unit 12 responsive to a signal from the sensor for controlling the rotational speed of the photosensitive drum 1 by the driving motor, and controllers 13 responsive to control signals from the control unit to control motors 14 for driving the photosensitive drum 1 and others at specified speeds. Instead of using the pump 10, a fan or blower may be used.

The smaller the volume of the solvent vapor collection unit 5, the more the collecting capacity increases. The closer the solvent vapor collection unit is mounted to the drum surface, or the lower the unit is mounted, the more the collecting capacity increases. This is because the solvent vapor is prone to reside in the lower portion of the apparatus; for the solvent vapor is much heavier than air (assuming air to have a specific gravity of unity, the specific gravity of the petroleum insulating solvent is about 5.9). A plurality of pipes may be coupled with the solvent vapor collection unit 9.

Figure 2:
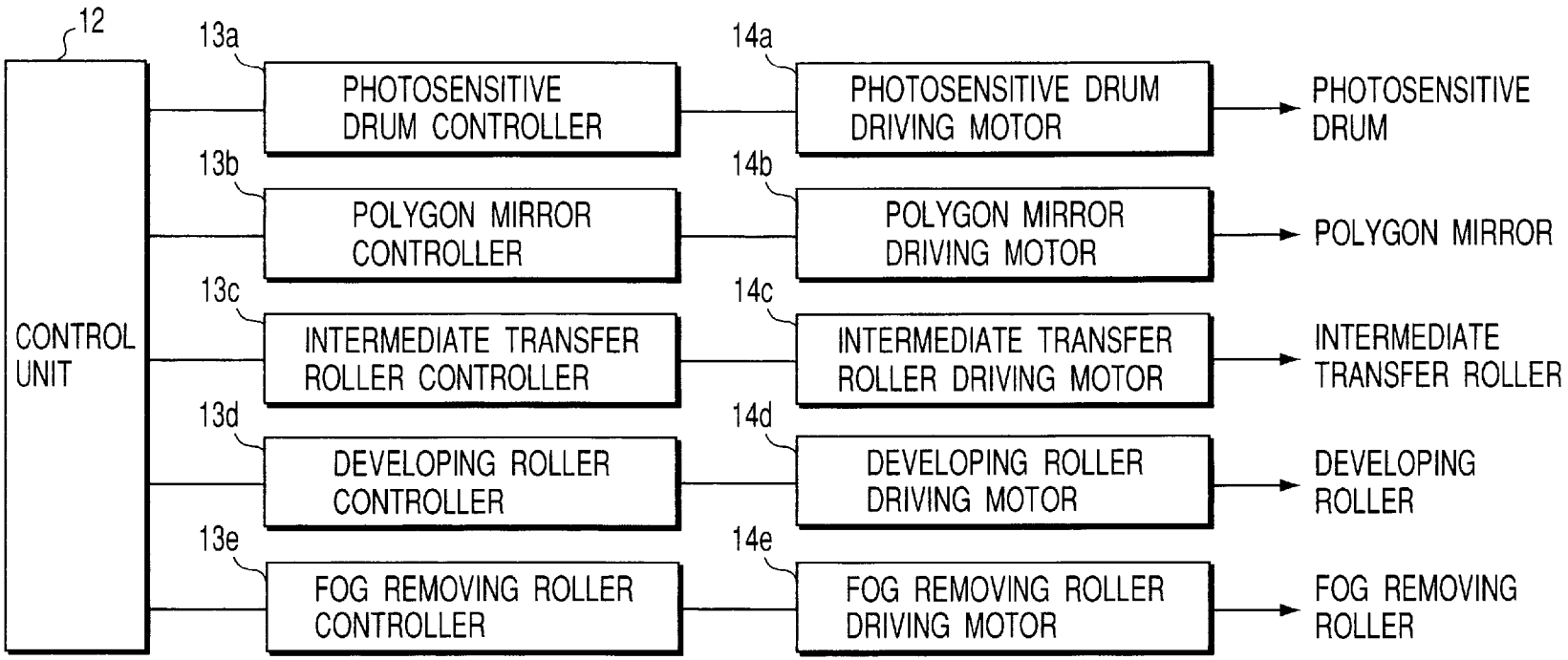
FIG. 2 is a diagram for use in explanation of controllers and motors used in the apparatus of FIG. 1.

The controllers 13 and the motors 14 are shown in detail in FIG. 2. The controllers comprise a photosensitive drum controller 13*a*, a polygon mirror controller 13*b*, an intermediate transfer roller controller 13*c*, a developing roller controller 13*d*, and a fog removing roller controller 13*e*. The motors comprise a photosensitive drum driving motor 14*a*, a polygon mirror driving motor 14*b*, an intermediate transfer roller driving motor 14*c*, a developing roller driving motor 14*d*, and a fog removing roller driving motor 14*e*. These motors rotate the photosensitive drum, the polygon mirror for determining an exposure scanning frequency, the intermediate transfer roller, the developing rollers provided in the developing unit 3-1, 3-2, 3-3 and 3-4 for supplying the liquid developer, and the fog removing rollers provided in the developing units for removing excess developer. The developing rollers and the fog removing rollers are provided in pairs in the respective developing units, each developing roller being provided upstream in the direction of rotation of the drum and each fog removing roller being provided downstream.

Between the charger 2-1 and the developing unit 3-1 there is set a space through which a laser exposure beam L-1 emitted from a laser source passes. A paper P can intervene between the intermediate transfer roller 6 and the fixing roller 8. The photosensitive drum 1 is structured such that an organic or amorphous silicon-based sensitive layer is formed on a conductive body.

The chargers, the developing units and the liquid developer storage reservoirs are provided in correspondence with colors of yellow (Y), magenta (M), cyan (C), and black (Bk). The charger 2-1, the developing unit 3-1 and the reservoir 4-1 are provided for Y. The charger 2-2, the developing unit 3-2 and the reservoir 4-2 are provided for M, the charger 2-3, the developing unit 3-3 and the reservoir 4-3 for C, and the charger 2-4, the developing unit 3-4 and the reservoir 4-4 for Bk. The color components are arranged along the direction of rotation of the photosensitive drum in the order of Y, M, C, and Bk.

The solvent vapor collection unit 5 is provided to cover a portion of the surface of the photosensitive drum between the developing unit 3-4 and the intermediate transfer roller 6 in a nearly airtight manner. The collection unit is constructed to blow air or heated gas (including heated air) to that covered portion of the drum or warm the covered portion and evaporate the liquid developer.

The liquid developer contains a petroleum insulating solvent and charged particles (toner particles) dispersed in the solvent. To prevent the liquid developer or the solvent vapor from escaping from the apparatus, the chargers 2, the developing units 3, the solvent vapor collection unit 5, the intermediate transfer roller 6 and the residual liquid developer recovery unit 7 are housed in a nearly hermetically sealed housing 20.

Next, the operation of the first embodiment will be described below.

It is assumed here that the photosensitive drum 1 is at a stop as long as the user does not enter a command to start printing and the drum is driven to rotate at a given speed in the direction indicated by an arrow in FIG. 1 after a command to start printing is entered.

First, an area of the photosensitive drum 1 where an electrostatic latent image is to be formed is uniformly electrified by the charger 2-1 and the electrically charged area is then exposed to an image-modulated laser beam L-1, so that the latent image is formed in the exposed area.

Next, the liquid developer is supplied by the developing unit 3-1 to the latent image formed area to make the latent image visible. This developing process for Y color is referred to as the first developing process.

Subsequent to the first developing process, an area of the photosensitive drum 1 where an electrostatic latent image is to be formed is uniformly electrified by the charger 2-2 and the electrically charged area is then exposed to an image-modulated laser beam L-2 from a laser source, so that the latent image is formed in the exposed area. Next, the liquid developer is supplied by the developing unit 3-2 to the latent image formed area to make the latent image visible. This developing process for M color is referred to as the second developing process. After the termination of the second developing process, a toner image is formed in two colors of Y and M on the surface of the photosensitive drum 1.

Subsequent to the second developing process, an area of the photosensitive drum 1 where an electrostatic latent image is to be formed is uniformly electrified by the charger 2-3 and the electrically charged area is then exposed to an image-modulated laser beam L-3 from a laser source, so that the latent image is formed in the exposed area. Next, the liquid developer is supplied by the developing unit 3-3 to the latent image formed area to make the latent image visible. This developing process for C color is referred to as the third developing process. After the termination of the second developing process, a toner image is formed in three colors of Y, M, and C on the surface of the photosensitive drum 1.

Subsequent to the third developing process, an area of the photosensitive drum 1 where an electrostatic latent image is to be formed is uniformly electrified by the charger 2-4 and the electrically charged area is then exposed to an image-modulated laser beam L-4 from a laser source, so that the latent image is formed in the exposed area. Next, the liquid developer is supplied by the developing unit 3-4 to the latent image formed area to make the latent image visible. This developing process for Bk color is referred to as the fourth developing process. A full-color toner image is formed in four colors of Y, M, C, and Bk on the surface of the photosensitive drum 1 after the termination of the fourth developing process.

Next, after the full-color toner image has been formed, the solvent vapor collection unit 5 evaporates the liquid developer adhered to the drum 1 and then collects the solvent vapor before the toner image reaches the intermediate transfer roller 6.

After excess liquid developer on the drum surface has been collected, the visible image is transferred to the intermediate transfer roller 6. The visible image on the roller 6 is then transferred, under the pressure of the fixing roller 8, to a paper P between the rollers 6 and 8. The transfer of the visible image from the drum 1 to the intermediate transfer roller 6 and from the roller 6 to the paper P may be made by means of either field transfer, pressure transfer, or heat transfer. Among liquid developers are ones which allow fixing onto paper at room temperature. However, thermal fixing may be performed by heating the fixing roller 8 as disclosed in U.S. Pat. No. 5,570,173. The paper P to which the visible image has been transferred and fixed is carried to the outside of the apparatus by means of a paper transport mechanism not shown.

After the visible image on the drum has been transferred to the intermediate transfer roller 6, the residual liquid developer and toner on the drum surface are removed by a roller or blade in the residual liquid developer recovery unit 7 so as not to damage the drum surface.

After the residues on the drum surface have been removed, a new latent image is formed on the drum surface by the charger 2-1 and the above processes are then taken.

The solvent vapor collected by the solvent vapor collection unit 6 is conducted by the pump 10, together with air in the housing, to the solvent vapor separation unit 9 where air and the solvent vapor are separated by the solvent being liquefied by cooling and only the liquefied solvent is recovered. The solvent vapor density in the gas discharged from the unit 9 is in the range of, say, several parts of million to tens of parts of million (ppm).

The subsequent operation will be described next with reference to FIG. 3.

By the time the gas which consists of air and unrecovered solvent vapor discharged from the solvent vapor collection unit 9 is discharged to the outside of the apparatus, the level of the solvent vapor in the gas is measured by the sensor 11, the measurement being sent to the control unit 12.

The control unit 12 makes a decision of whether or not the measured level is above a preset allowable value (critical value) (step A1). If NOT (e.g., if the level is below 10 ppm), then the drum 1 is continued to rotate at the normal speed. If YES, on the other hand, the control unit 12 sends control signals to the controllers 13 to reduce the rotational speeds of the drum 1, the polygon mirror (the speed at which the drum is scanned by laser beams), the intermediate transfer roller 6, the developing rollers, and the fog removing rollers (step A2).

The reduced rotational speed of the drum 1 is set according to the throughput (capacity) of the solvent gas separation unit 9 adapted to separate the solvent vapor only from the mixed gas of air and the solvent vapor introduced from the solvent vapor collection unit 5. The amount of the solvent vapor introduced into the unit 9 per unit time is set to be smaller than the throughput of the unit 9.

After the rotational speeds of the drum and others have been reduced, the control unit 12 makes a decision of whether the measured level of the solvent vapor density by the sensor 11 has fallen below the allowable value (step A3). If NOT, the drum and others are kept rotating at speeds lower than their normal speeds; otherwise, the control unit sends control signals to the controllers 13 to allow the drum and others to rotate at their normal speeds (step A4). After that, the procedure returns to step A1.

It should be noted here that the critical value in step A1 and the critical value in step A3 need not necessarily be set to an equal value.

According to the first embodiment, the discharge of the solvent vapor to the outside of the image formation apparatus can be controlled to a minimum and the solvent vapor can be separated and recovered in an efficient manner, thus providing human body- or environmental-friendly apparatus.

In particular, since the measured level of the solvent vapor density by the sensor 11 is used to determine the rotational speeds of the drum 1 and others to conform to the capacity of the solvent vapor separation unit 9, the discharge of the solvent vapor to the outside of the apparatus can be controlled more efficiently, increasing safety.

<Second Embodiment>

Figure 4:
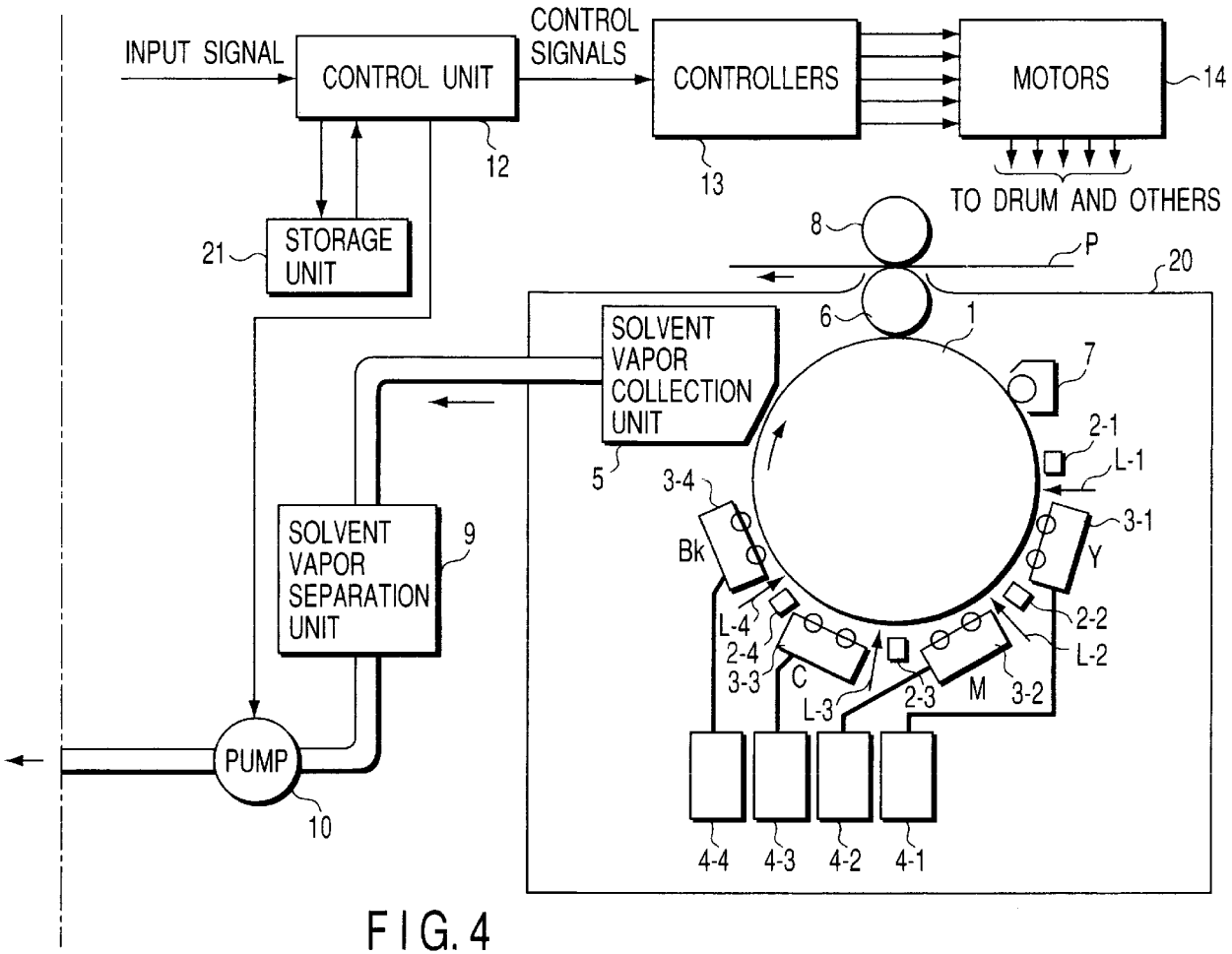
FIG. 4 is a schematic representation of an image formation apparatus according to a second embodiment of the present invention.

FIG. 4 shows the configuration of an image formation apparatus according to a second embodiment of the present invention.

In FIG. 4, like reference numerals are used to denote corresponding components to those in FIG. 1 and detailed descriptions thereof are omitted. The differences of the second embodiment from the first embodiment will be described mainly.

The second embodiment is characterized in that the rotational speeds of the drum 1 and others and the processing time for solvent vapor separation after the main power supply to the apparatus has been turned off are determined based on the number of pages to be printed per unit time, not based on the measured level of the solvent vapor density by the sensor as in the first embodiment.

A storage unit 21 shown in FIG. 4 is prestored with data on the rotational speeds of the drum 1, the polygon mirror, the intermediate transfer roller, the developing rollers and the fog removing rollers which conform to the capacity of the solvent vapor separation unit 9 and the operating times of the pump 10 and the solvent vapor separation unit 9 after the main power supply has been turned off. The data stored in the unit 21 is referred to by the control unit 12.

The exemplary information stored in the storage unit 21 will be described with reference to FIGS. 5 and 6.

Figures 3, 5, 6:
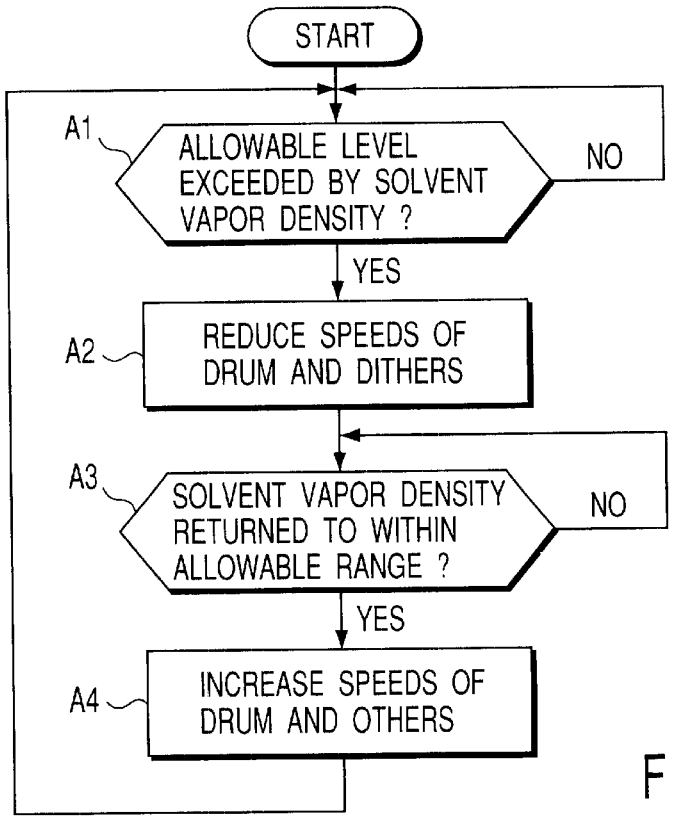
FIG. 3 is a flowchart illustrating the operation of the apparatus of FIG. 1.
FIG. 5 is a table for determining the rotational speeds of the photosensitive drum in the apparatus of FIG. 4.
FIG. 6 is a table for determining the operating times for solvent vapor separation after power off in the apparatus of FIG. 4.

FIG. 5 is a first table used to determine the suitable rotational speeds of the drum and others taking the capacity of the solvent vapor separation unit 9 into account. Here, a relationship between the number of pages per unit time and the rotational speed of the photosensitive drum 1 is defined in the table. Although the rotational speeds of the polygon mirror and the rollers other than the drum are omitted here, their speeds are also determined according to the rotational speeds of the drum.

For example, when the number of pages per unit time is 10 or less, the rotational speed of the drum is set to Vx (normal speed). When the number of pages per unit time is in the range of 11 to 50, the rotational speed of the drum is set to Vy (<Vx) so as to reduce loading of the solvent vapor separation unit 9. When the number of pages per unit time is in the range of 51 to 100, the rotational speed of the drum is set to Vz (<Vy) in order to further reduce loading of the solvent vapor separation unit 9.

FIG. 6 is a second table used to determine the appropriate operating time of the pump 10 taking into account the residual amount of solvent vapor after the main power supply to the apparatus has been turned off. Here, a relationship is defined among the elapsed time from the termination of printing, the number of pages per unit time, and the operating times of the pump 10 and the solvent vapor separation unit 9.

For example, when the elapsed time from the termination of printing is less than a predetermined value Tth, the operating time of the pump 10 and the unit 9 is set to Ta. If, when the elapsed time from the termination of printing is less than a predetermined value Tth, the number of pages per unit time is 20 or less, then the operating time of the pump 10 and the unit 9 is set to Tb. If the number of pages per unit time is in the range of 21 to 50, then the operating time of the pump 10 and the unit 9 is set to Tc.

Note that the image formation apparatus is equipped with an auxiliary power supply and the solvent vapor is recovered through the use of this auxiliary power supply after the main power supply has been turned off.

Figure 7A:
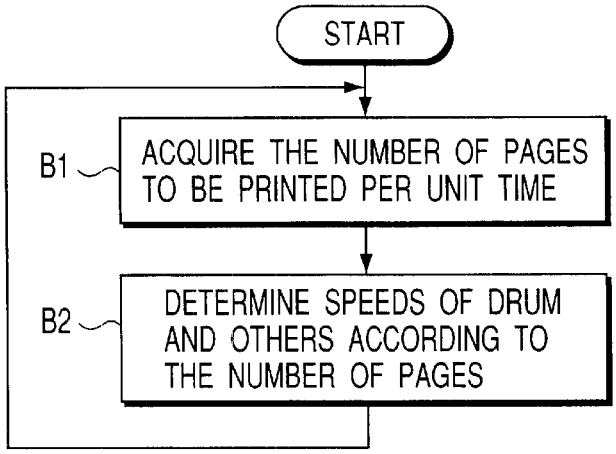
FIGS. 7A and B are flowcharts illustrating the operation of the apparatus of FIG. 4.
Figure 7B:
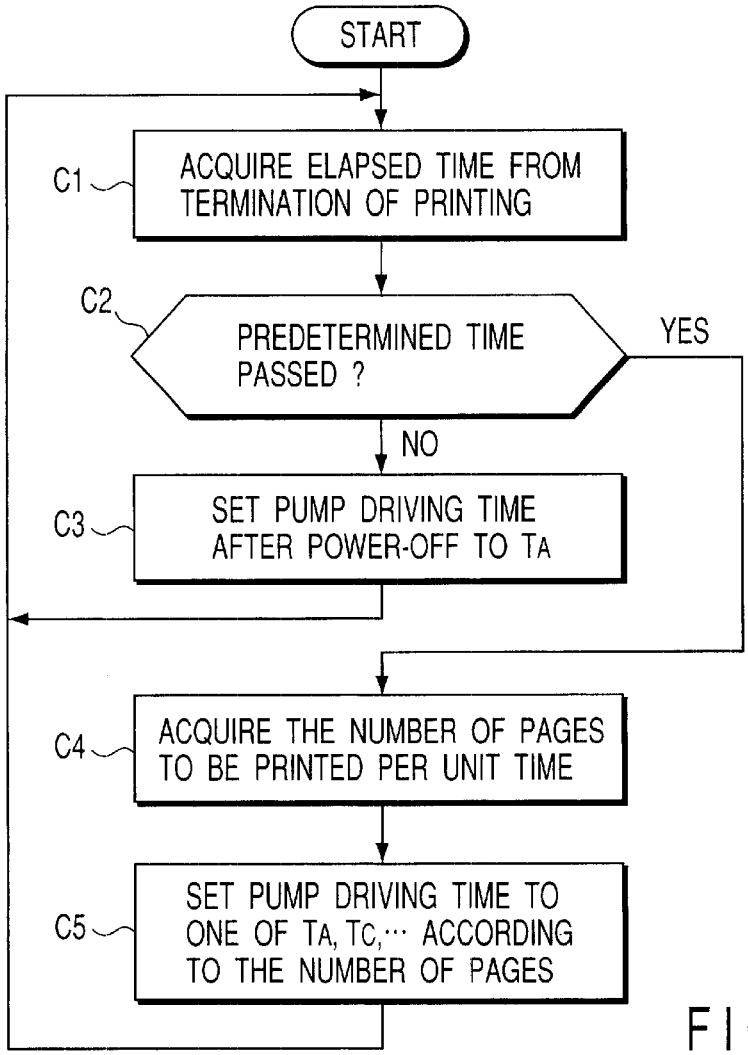

Next, the operation of the second embodiment will be described using flowcharts illustrated in FIGS. 7A and 7B.

Upon receiving data concerning printing, the control unit 12 acquires the number of pages to be printed per unit time at regular intervals (step B1).

The control unit refers to the first table (FIG. 5) stored in the storage unit 21, then determines the rotational speeds of the drum, the polygon mirror, the intermediate transfer roller, the developing rollers and the fog removing rollers which correspond to the number of pages per unit time acquired in step B1, and sends corresponding control signals to the controllers 13 (step B2). The procedure then returns to step B1.

The above operation may be modified in such a way that, when the drum is in rotation at the normal speed, a decision is made as to whether or not the number of pages to be printed per unit time (or the number of pages the apparatus is told) is one for which the solvent vapor separation unit 9 can recover the solvent vapor attendant on printing with certainty, and if YES, the drum and others are kept rotating at their normal speeds, otherwise they are kept rotating at the normal speeds until a predetermined number of pages have been printed out and are then reduced to lower speeds to print the remaining pages, thereby controlling the production of the solvent vapor.

When the main power supply to the apparatus is turned off, the control unit 12 acquires the elapsed time from the termination of printing (step C1). When printing is in execution, the elapsed time is considered zero. The control unit next refers to the second table (FIG. 6) in the storage unit 21 to determine the operating time of the solvent vapor separation unit 9 after the main power supply has been turned off.

That is, the control unit makes a decision of whether or not the elapsed time is after a predetermined time (step C2). If NOT, the operating time of the pump 10 and the solvent vapor separation unit 9 after the main power supply has been turned off is set to Ta (step C3). If YES in step C2, then the control unit acquires the number of pages to be printed per unit time (step C4) and sets the operating time of the pump 10 and the solvent vapor separation unit 9 after power off to one of Tb, Tc, and so on which corresponds to the number of pages per unit time (step C5). The control unit 12 then drives the pump 10 and the solvent vapor separation unit 9 for the set operating time only.

Thereby, the solvent vapor in the housing 20 and the pipe coupled with the solvent vapor collection unit 5 is recovered by the pump 10 until the time at which the solvent vapor density in the housing has dropped below the allowable level.

According to the second embodiment as described above, the same advantages as in the first embodiment are provided and moreover the rotational speeds of the drum 1 and others which conform to the capacity of the solvent vapor separation unit 9 and the processing time for vapor recovery after the main power supply has been turned off are determined based on the number of pages to be printed per unit time. Therefore, the discharge of the solvent vapor to the outside can be controlled in a more efficient manner and the safety can be increased. In addition, the elimination of need of the density sensor results in a reduction in cost.

<Third Embodiment>

Figure 8:
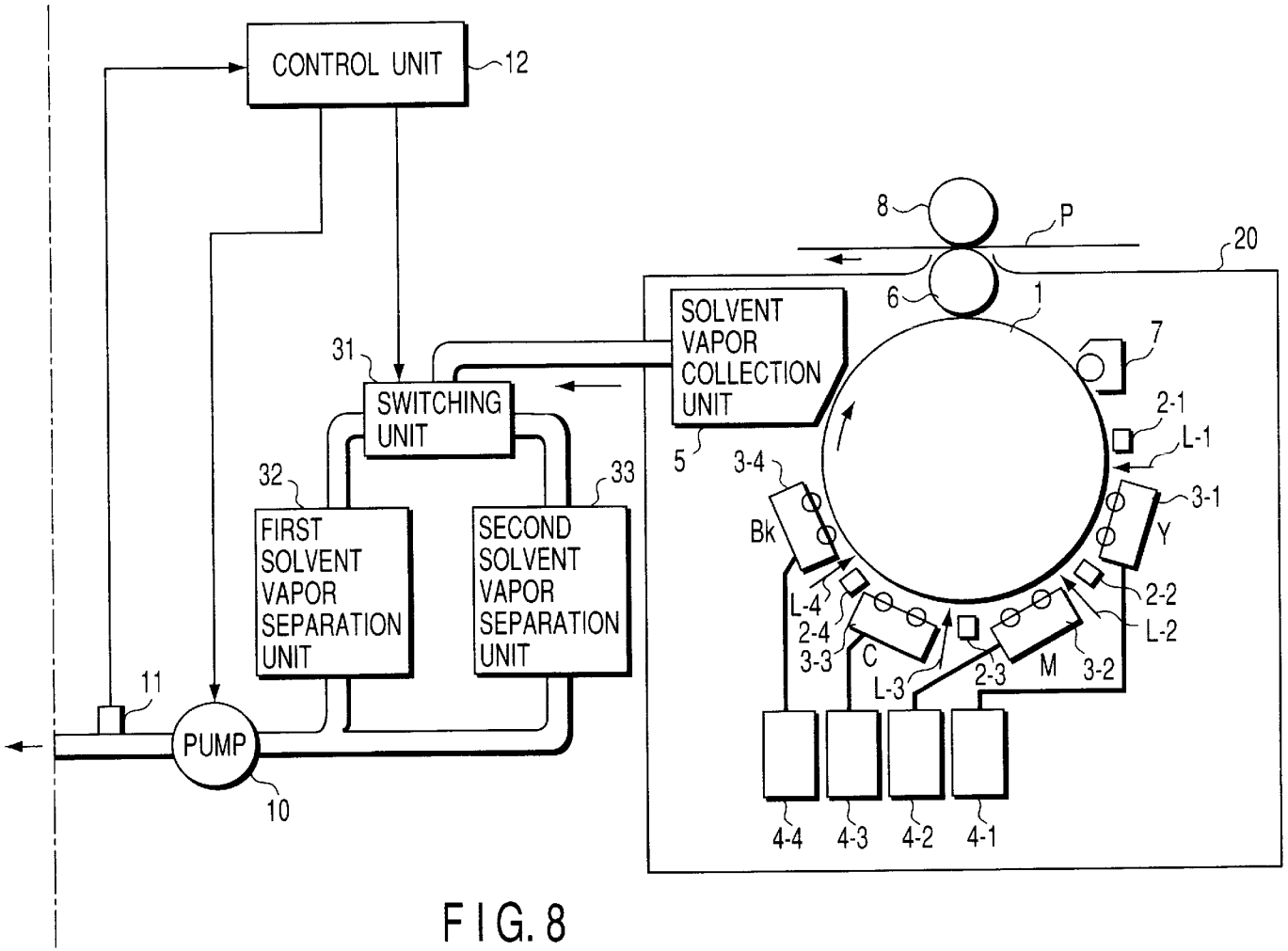
FIG. 8 is a schematic representation of an image formation apparatus according to a third embodiment of the present invention.

FIG. 8 shows the configuration of an image formation apparatus according to a third embodiment of the present invention.

In FIG. 8, like reference numerals are used to denote corresponding components to those in FIG. 1 and detailed descriptions thereof are omitted. The differences of the third embodiment from the first embodiment will be described mainly.

The third embodiment is characterized in that there are provided a plurality of solvent vapor separation units which differ in the way to separate air and solvent vapor and a suitable unit to be used is selected based on the number of pages to be printed per unit time.

As shown in FIG. 8, there are provided a first solvent vapor separation unit 32 and a second solvent vapor separation unit 33. For example, the first unit 32 is adapted to separate and recover the solvent vapor by cooling liquefaction. The second unit 33 uses an absorbent, such as activated charcoal, silica gel, or the like, or a catalyst, such as platinum or the like. Though short in life, the second unit is adapted to recover the solvent vapor more quickly than the first unit.

The solvent vapor collected by the solvent vapor collection unit 5 is selectively introduced into the unit 32 or 33 by means of a switching unit such as a three-way valve.

Figure 9:
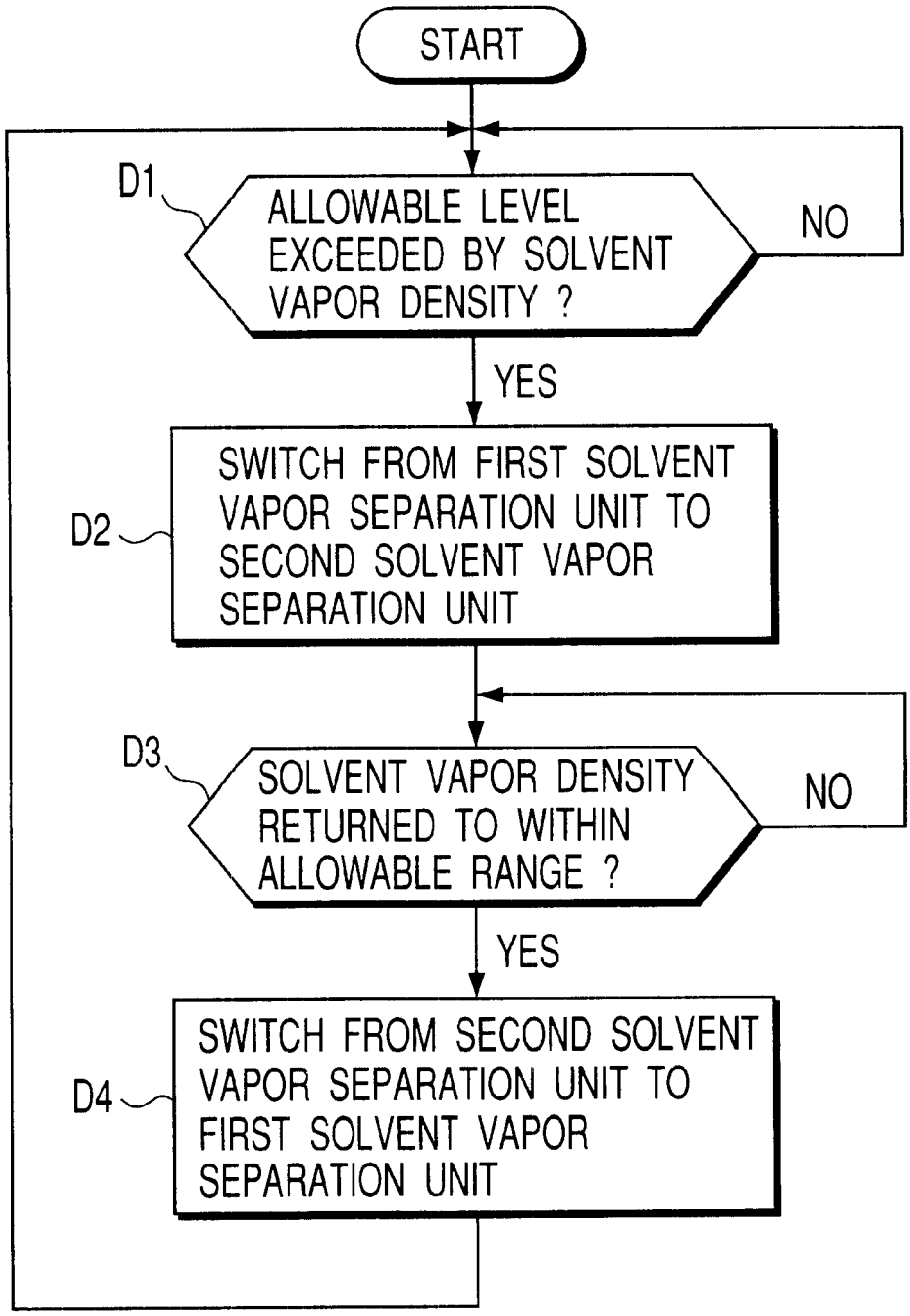
FIG. 9 is a flowchart illustrating the operation of the apparatus of FIG. 8.

The operation of the third embodiment will be described next using a flowchart of FIG. 9.

Normally, the switching unit 31 is set to introduce a gas consisting of solvent vapor and air from the unit 5 into the first solvent vapor separation unit 32. The gas passed through the first unit 32, which contains solvent vapor in the range of several parts to tens of parts of million (ppm), is discharged to the outside of the apparatus by the pump 10. Before being discharged to the outside, the gas is subjected to solvent vapor density measurements by the density sensor 11. The measurements are sent to the control unit 12.

The control unit 12 makes a decision of whether or not the level of the solvent vapor measured by the sensor is above an allowable value (critical value) (step D1). If NOT, the recovery of the solvent vapor by the first unit 32 is continued. If YES, on the other hand, the control unit instructs the switching unit 31 to introduce the gas containing the solvent vapor from the collection unit 5 into the second separation unit 33 (step D2).

Thereby, the second separation unit 33 is allowed to separate and recover the solvent vapor. As a result, vapor-recovering capacity is improved in comparison with prior to switching.

After switching to the second separation unit 33, the control unit 12 makes a decision of whether the level of the solvent vapor measured by the sensor has fallen below the allowable level (step D3). If NOT, the recovery of the solvent vapor by the second separation unit 33 is continued. If YES, on the other hand, the control unit instructs the switching unit to introduce the gas containing the solvent vapor into the first separation unit 32 (step D4).

Thereby, the solvent vapor is separated and recovered by the first separation unit 32. As a result, the separating capacity (recovering capacity) returns to the normal capacity. After that, the procedure is repeated starting with step D1.

At the termination of printing, the control unit instructs the switching unit to introduce the gas containing the solvent vapor from the collection unit 5 into the first separation unit 32.

The gas from the collection unit 5 may be introduced simultaneously into each of the first and second separation units 32 and 33 as required.

According to the third embodiment as described above, the same advantages as in the first embodiment are provided and moreover a plurality of solvent vapor separation units each having a different recovery capacity are selectively used based on measured values for solvent vapor density by the density sensor. Therefore, the discharge of the solvent vapor to the outside can be controlled in a more efficient manner and the safety can be increased.

Additionally, if, in such a case as a large number of pages are printed in succession, the vapor-separating capacity (vapor-recovering capacity) of the first solvent vapor separation unit 32 normally used is insufficient to deal with the resultant solvent vapor, the quick-acting second separation unit 33 is used in place of the first separation unit 32, allowing efficient separation and recovery of the solvent vapor without affecting the printing.

<Fourth Embodiment>

Figure 10:
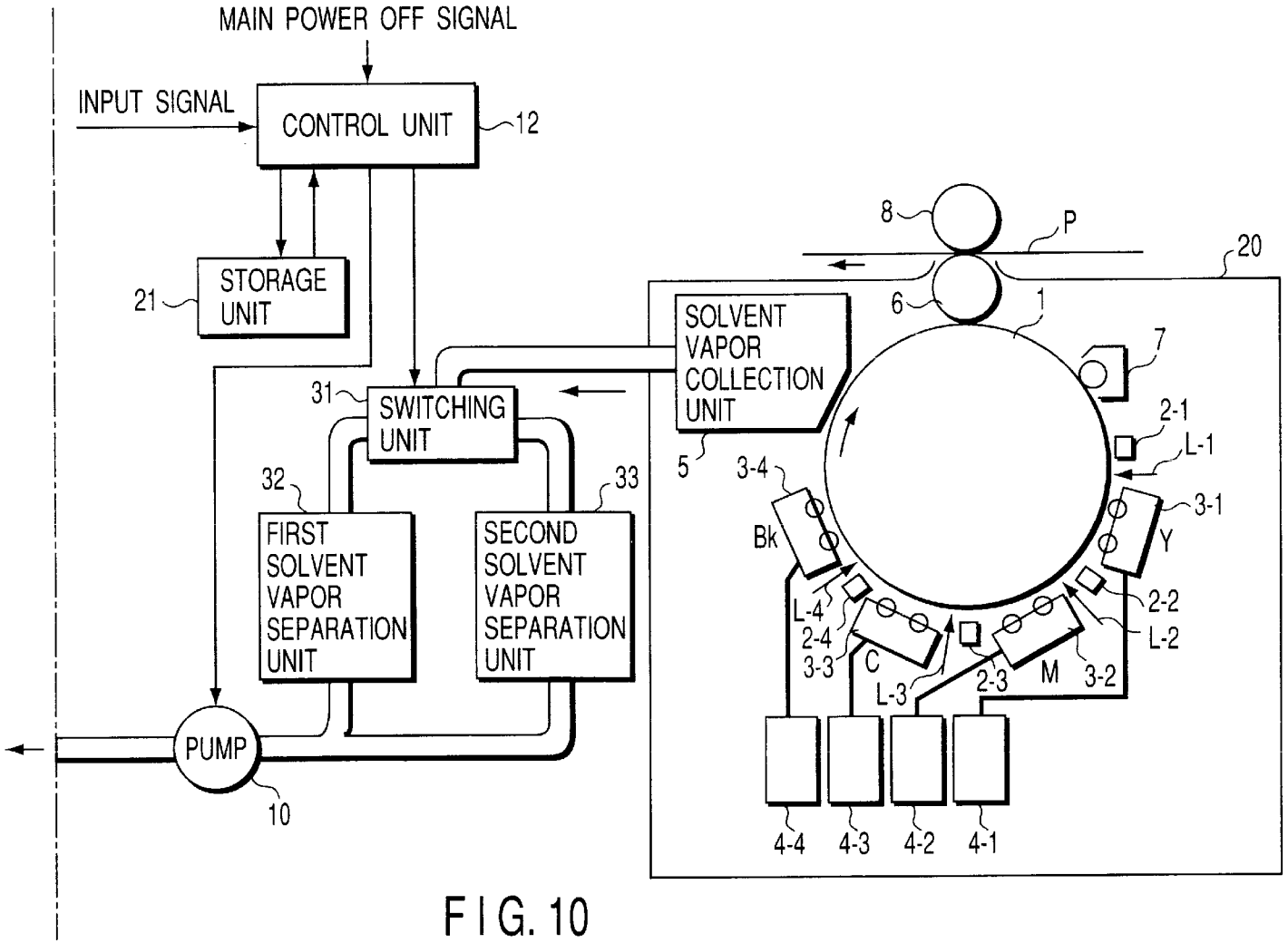
FIG. 10 is a schematic representation of an image formation apparatus according to a fourth embodiment of the present invention.

FIG. 10 shows the configuration of an image formation apparatus according to a fourth embodiment of the present invention.

In FIG. 10, like reference numerals are used to denote corresponding components to those in the third embodiment shown in FIG. 8 and detailed descriptions thereof are omitted. The differences of the fourth embodiment from the third embodiment will be described mainly.

The fourth embodiment is characterized in that a suitable vapor separation unit to be used is selected from the plurality of separation units based on the number of pages to be printed per unit time, not on the measured level of the vapor density as in the third embodiment.

The storage unit 21 shown in FIG. 10 is prestored with information indicating solvent vapor separation units which are to be used selectively according to the number of pages to be printed per unit time. The information in the storage unit is used by the control unit 12.

Figure 11:
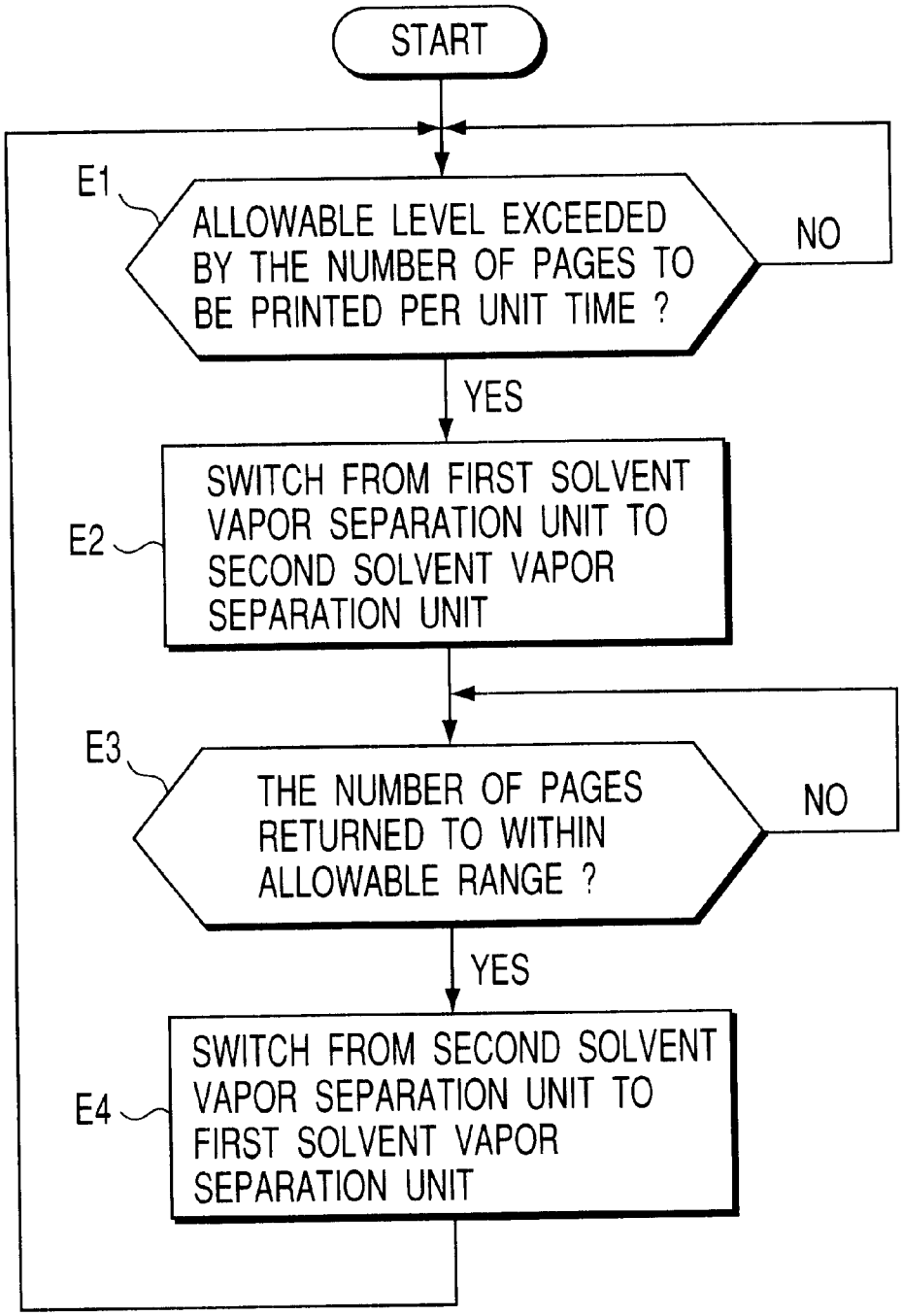
FIG. 11 is a flowchart illustrating the operation of the apparatus of FIG. 10.

The operation of the fourth embodiment will be described next using a flowchart of FIG. 11.

Upon receipt of data on printing, the control unit 12 acquires the number of pages to be printed per unit time at regular intervals.

The control unit refers to the information stored in the storage unit 21 to make a decision of whether or not the number of pages acquired is above an allowable value (step E1). If NOT, the separation and recovery of solvent vapor is continued by the first separation unit 32; otherwise, the control unit instructs the switching unit 32 to introduce the gas containing the solvent vapor from the solvent vapor collection unit 5 into the second separation unit 33 (step E2).

Thereby, the gas is caused to flow into the second separation unit 33 where the solvent vapor is separated and recovered. As a result, the vapor recovery capacity is increased compared to before switching.

After switching to the second separation unit 33, the control unit 12 makes a decision of whether the number of pages to be printed per unit time has fallen below the allowable value (step E3). If NOT, the separation and recovery of the solvent vapor by the second separation unit 33 is continued. If YES, on the other hand, the control unit instructs the switching unit to introduce the gas containing the solvent vapor from the collection unit 5 into the first separation unit 32 (step E4).

Thereby, the solvent vapor is separated and recovered by the first separation unit 32. As a result, the vapor-separating capacity (vapor-recovering capacity) returns to the normal capacity. After that, the procedure is returns to step E1.

At the termination of printing, the control unit instructs the switching unit to introduce the gas containing the solvent vapor from the collection unit 5 into the first separation unit 32.

The gas from the collection unit 5 may be introduced simultaneously into each of the first and second separation units 32 and 33 as required.

The above operation may be modified in such a way that: when the solvent vapor is separated and recovered by the first separation unit 32, a decision is made as to whether or not the number of pages to be printed per unit time (or the number of pages the apparatus is told) is one for which the first solvent vapor separation unit 32 can recover the solvent vapor attendant on printing with certainty. If YES, the operation of the first separation unit 32 is continued, otherwise the first separation unit 32 is operated until a predetermined number of pages have been printed out and the second separation unit 33 is then put into operation when the remaining pages are printed, thereby controlling the production of the solvent vapor.

The processing when the main power supply to the apparatus is turned off, as described in connection with the second embodiment, is also applicable to the fourth embodiment.

According to the fourth embodiment as described above, the same advantages as in the third embodiment are provided. Moreover, a plurality of solvent vapor separation units each having a different recovery capacity are selectively used according to the number of pages to be printed per unit time. Therefore, the discharge of the solvent vapor to the outside can be controlled in a more efficient manner and the safety can be increased. In addition, the elimination of need of the density sensor results in a reduction in cost.

<Fifth Embodiment>

Figure 12:
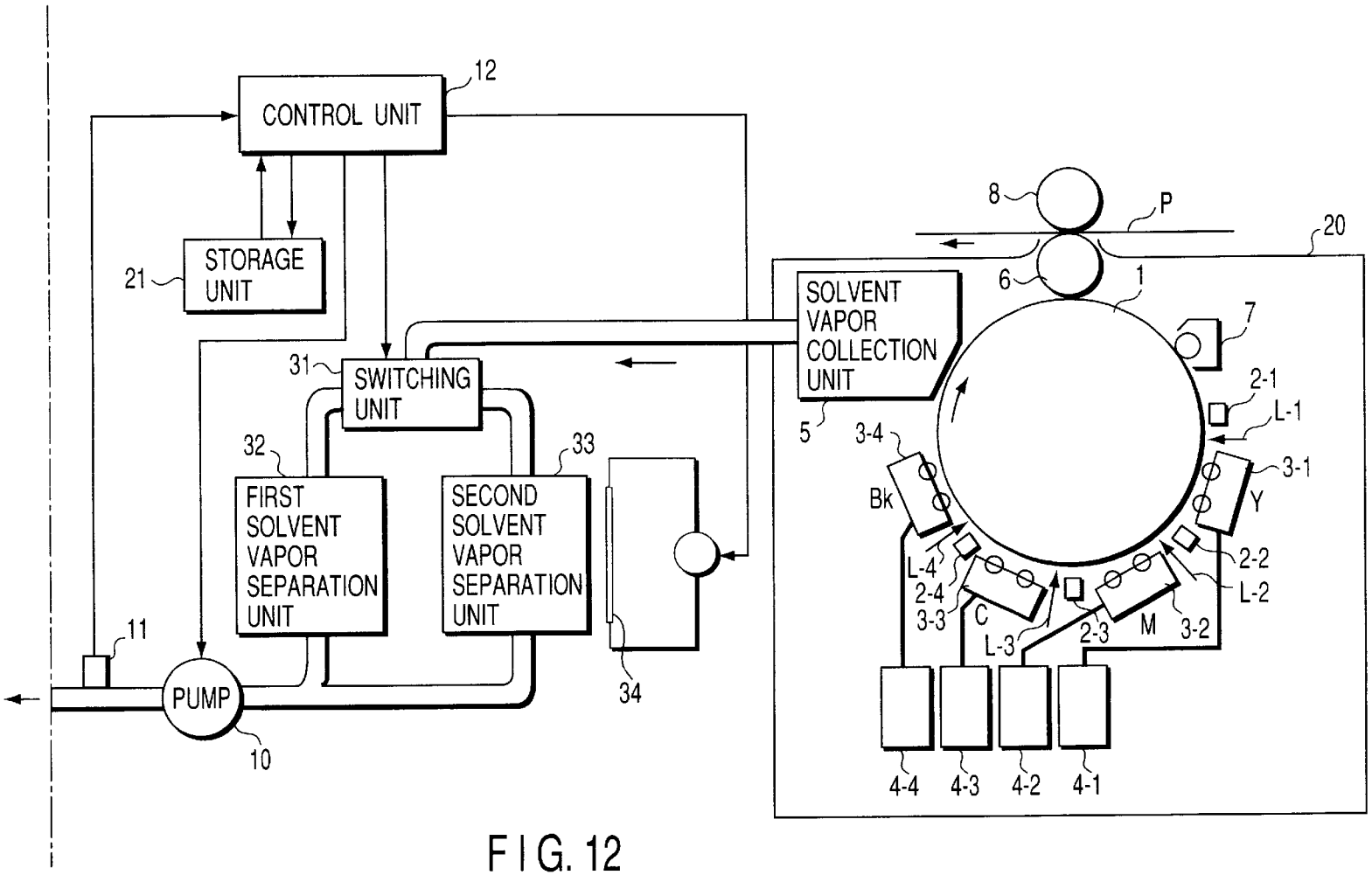
FIG. 12 is a schematic representation of an image formation apparatus according to a fifth embodiment of the present invention.

FIG. 12 shows the configuration of an image formation apparatus according to a fifth embodiment of the present invention.

In FIG. 12, like reference numerals are used to denote corresponding components to those in the third embodiment shown in FIG. 8 and detailed descriptions thereof are omitted. The differences of the fifth embodiment from the third embodiment will be described mainly.

The fifth embodiment is characterized in that there is provided a vapor-separating capacity restoration unit 34 in the vicinity of either of the vapor separation units 32 and 33.

As shown in FIG. 12, in the vicinity of either of the vapor separation units 32 and 33 whose vapor-separating capacity can be restored, there is provided a vapor-separating capacity restoration unit 34. Although, in the figure, the capacity restoration unit 34 is provided in the vicinity of the second separation unit 33, the restoration unit may be provided in the vicinity of the first separation unit 32 or in the vicinity of each of the first and second separation units. In view of the capacity restoring efficiency, the restoration unit 34 should preferably be installed in the vicinity of the less frequently used vapor separation unit 33 as shown.

When the first and second separation units 32 and 33 use activated charcoal or silica gel, the capacity restoration unit 34 is heating equipment. In this case, if the activated charcoal or silica gel bears a photocatalyst such as titanium oxide, it is advisable that the heating equipment be an ultraviolet lamp such as a cold cathode lamp or a black light.

Figure 13:
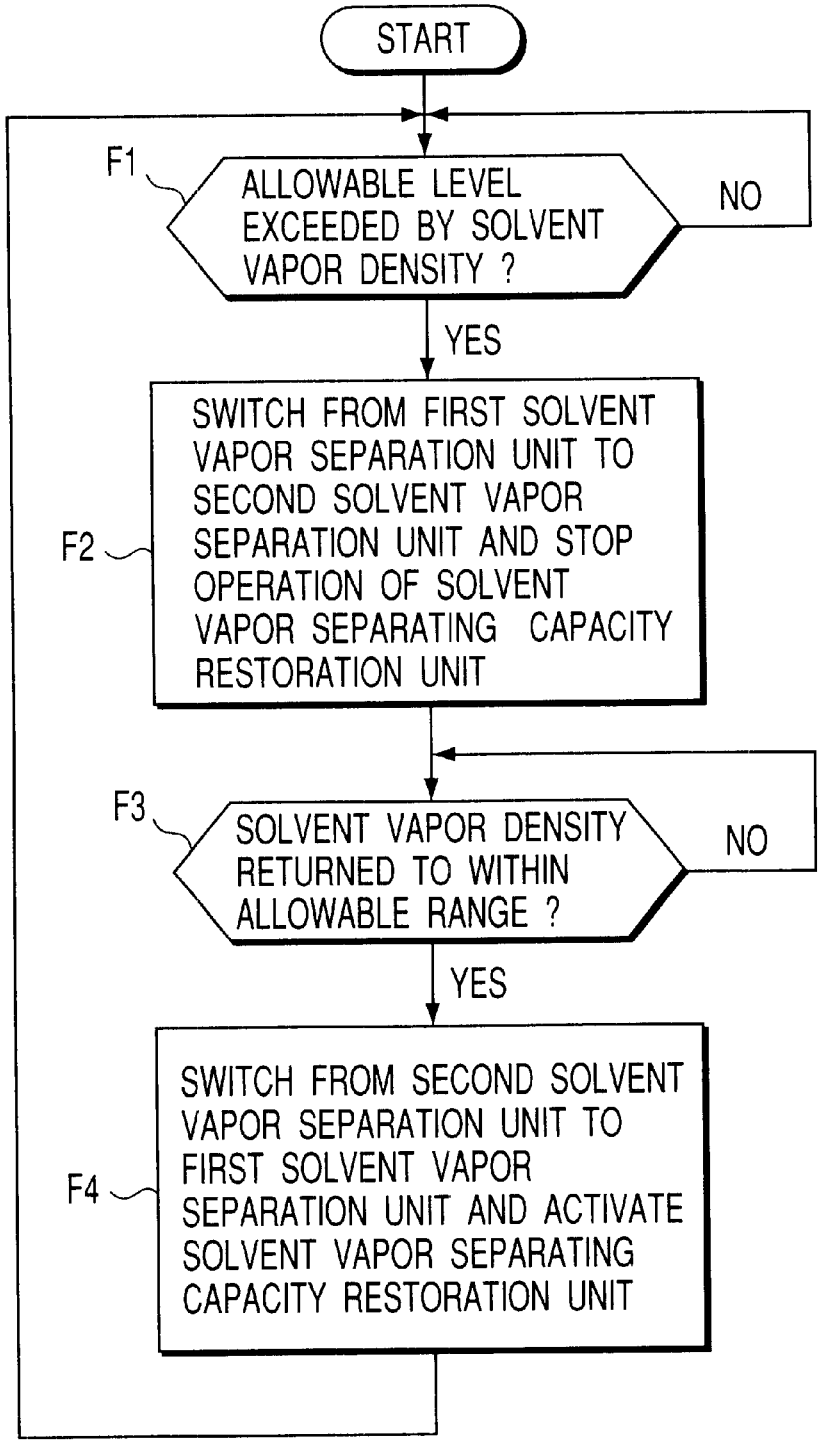
FIG. 13 is a flowchart illustrating the operation of the apparatus of FIG. 12.

Next, the operation of the fifth embodiment will be described using a flowchart of FIG. 13.

Normally, the switching unit 31 is set to introduce a gas containing solvent vapor and air from the vapor collection unit 5 into the first vapor separation unit 32. The gas passed through the first unit 32, which contains solvent vapor in the range of several parts to tens of parts of million (ppm), is discharged to the outside of the apparatus by the pump 10. Before being discharged to the outside, the gas is subjected to a solvent vapor density measurement by the density sensor 11. The measurement is sent to the control unit 12.

The control unit 12 makes a decision of whether or not the level of the solvent vapor measured by the sensor is above an allowable value (critical value) (step F1). If NOT, the recovery of the solvent vapor by the first unit 32 is continued. If YES, on the other hand, the control unit instructs the switching unit 31 to introduce the gas containing the solvent vapor from the collection unit 5 into the second separation unit 33 and stops the operation of the vapor-separating capacity restoration unit 34 (step F2).

Thereby, the gas is caused to flow into the second separation unit 33 where the solvent vapor is separated and recovered.

After switching to the second separation unit 33, the control unit 12 makes a decision of whether the level of the solvent vapor measured by the sensor has fallen below the allowable level (step F3). If NOT, the recovery of the solvent vapor by the second separation unit 33 is continued. If YES, on the other hand, the control unit instructs the switching unit to introduce the gas containing the solvent vapor into the first separation unit 32 and puts the vapor-separating capacity restoration unit 34 into operation (step F4).

Thereby, the vapor-separating capacity of the second vapor separation unit 33 which is not in use will be restored by the capacity restoration unit 34. After that, the procedure is repeated starting with step F1.

If the capacity restoration unit is heating equipment, the second separation unit 33 is heated by the heating equipment, so that solvent vapor is desorbed from the activated charcoal or silica gel. With a black light, the solvent absorbed by the activated charcoal or silica gel can be dissolved by ultraviolet irradiation. The dissolved solvent (vapor) is discharged from the second separation unit 33, then mixed with gas discharged from the first separation unit 32 and discharged to the outside by the pump 10.

The control unit 12 controls the capacity restoration unit 34 so that the density of the solvent vapor discharged from the second separation unit 33, including the gas discharged from the first separation unit 32, falls below the level at which it is allowed to be discharged to the outside of the apparatus.

According to the fifth embodiment as described above, the same advantages as in the third embodiment are provided and moreover the life of the second separation unit 33 can be increased because its vapor-separating capacity is restored when it is idle.

<Sixth Embodiment>

Figure 14:
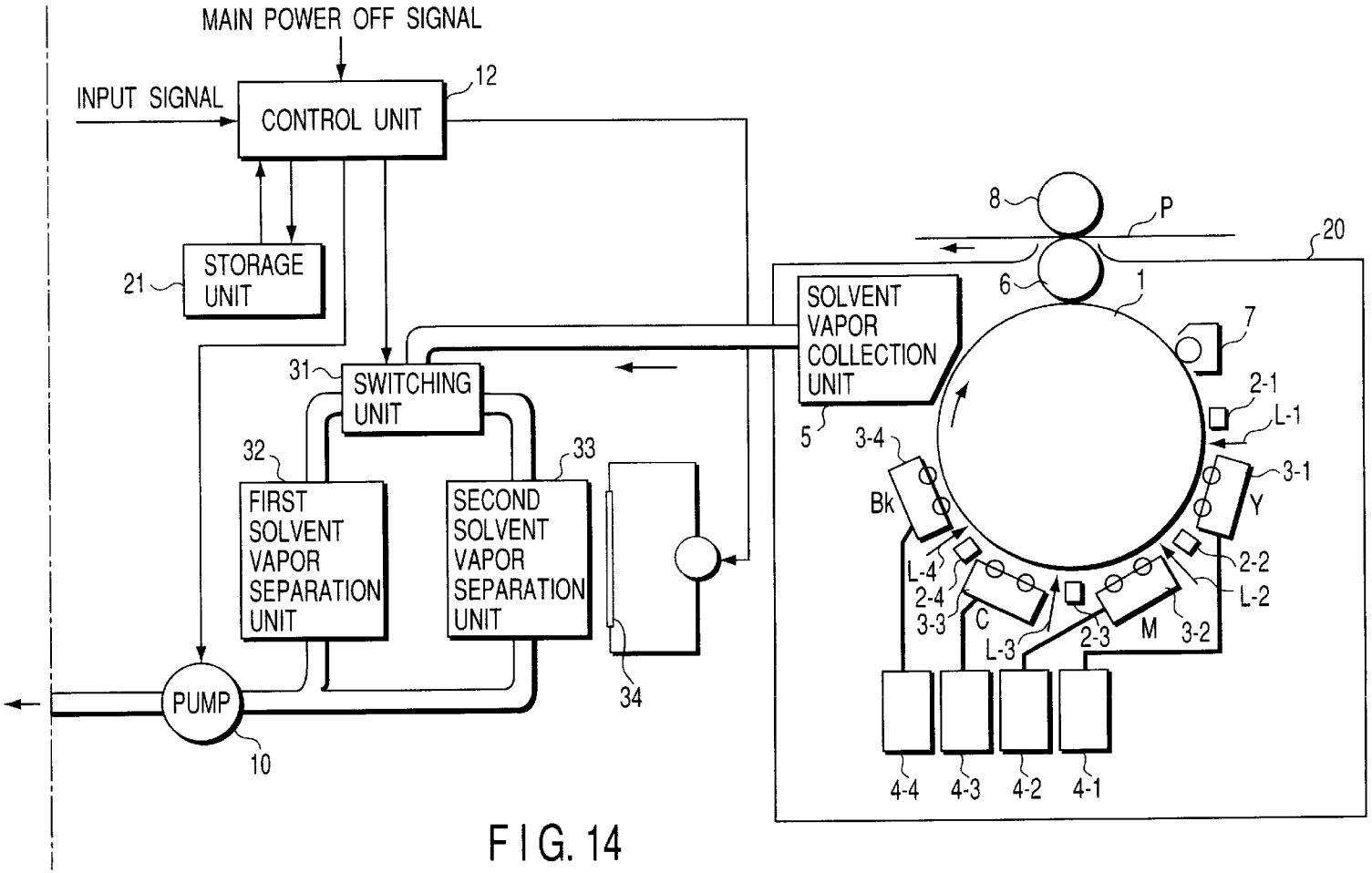
FIG. 14 is a schematic representation of an image formation apparatus according to a sixth embodiment of the present invention.

FIG. 14 shows the configuration of an image formation apparatus according to a sixth embodiment of the present invention.

In FIG. 14, like reference numerals are used to denote corresponding components to those in the fifth shown in FIG. 12 and detailed descriptions thereof are omitted. The differences of the sixth embodiment from the fifth embodiment will be described mainly.

The sixth embodiment is characterized in that a suitable vapor separation unit to be used is selected from the plurality of separation units based on the number of pages to be printed per unit time, not on the measured level of the vapor density as in the fifth embodiment, and the separating capacity of a solvent vapor separation unit is restored while it is idle.

The storage unit 21 shown in FIG. 14 is prestored with information indicating solvent vapor separation units which are to be used selectively according to the number of pages to be printed per unit time and information for controlling the capacity restoration unit 34 to restore the vapor-separating capacity of the second separation unit 33 while only the first separation unit 32 is in operation. The information in the storage unit is used by the control unit 12.

Figure 15:
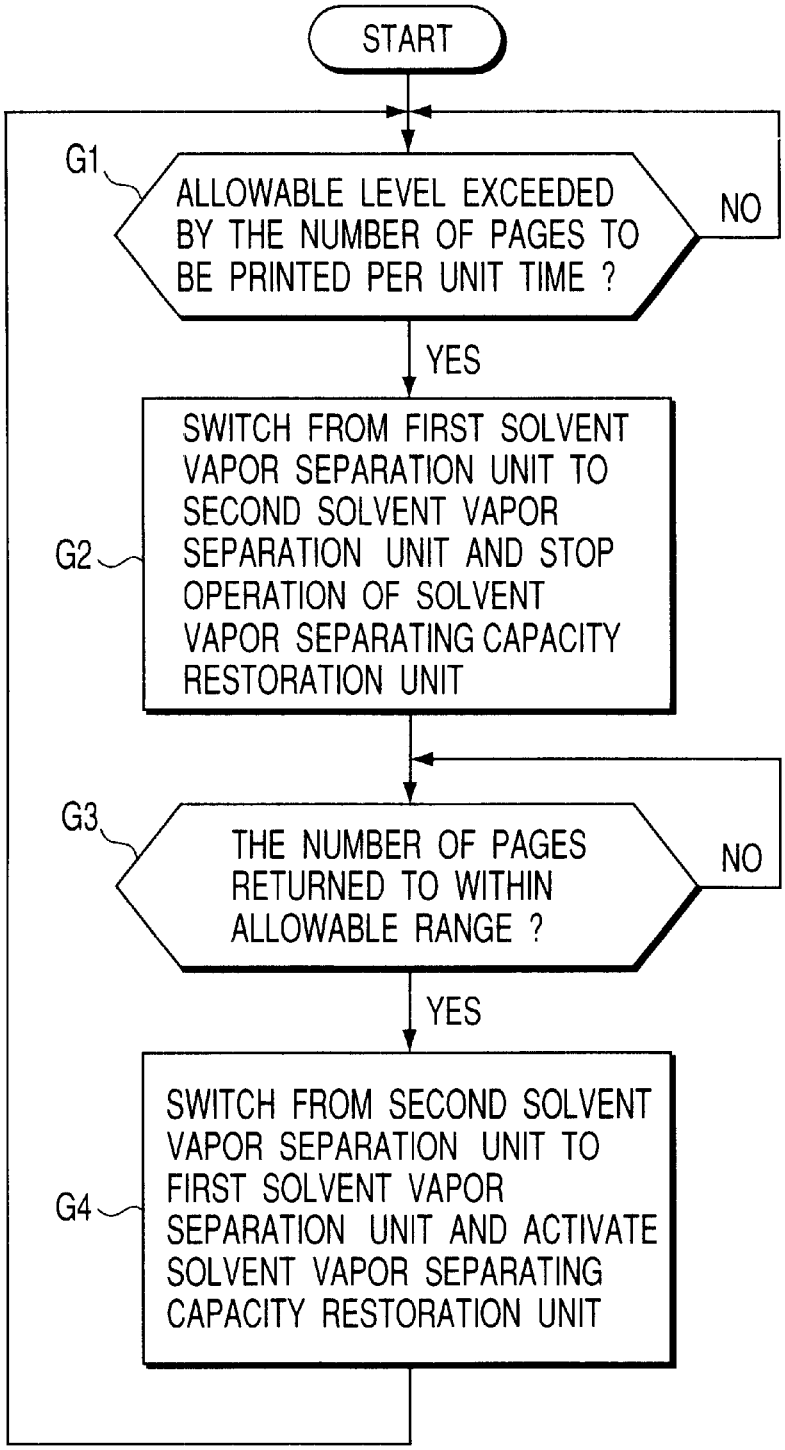
FIG. 15 is a flowchart illustrating the operation of the apparatus of FIG. 14.

The operation of the sixth embodiment will be described next using a flowchart of FIG. 15.

Upon receipt of data on printing, the control unit 12 acquires the number of pages to be printed per unit time at regular intervals.

The control unit refers to the information stored in the storage unit 21 to make a decision of whether or not the number of pages acquired is above an allowable value (step G1). If NOT, the separation and recovery of solvent vapor is continued by the first separation unit 32; otherwise, the control unit instructs the switching unit 32 to introduce the gas containing the solvent vapor from the solvent vapor collection unit 5 into the second separation unit 33 and stops the operation of the capacity restoration unit 34 (step G2).

Thereby, the gas is allowed to flow into the second separation unit 33 where the solvent vapor is separated and recovered.

After switching to the second separation unit 33, the control unit 12 makes a decision of whether or not the number of pages to be printed per unit time has fallen below the allowable value (step G3). If NOT, the separation and recovery of the solvent vapor by the second separation unit 34 is continued. If YES, on the other hand, the control unit instructs the switching unit to introduce the gas containing the solvent vapor from the collection unit 5 into the first separation unit 32 and puts the capacity restoration unit 34 into operation (step G4).

Thereby, the vapor-separating capacity of the second vapor separation unit 33 which is now in idle state is restored by the capacity restoration unit 34. After that, the procedure is returns to step G1.

The processing when the main power supply to the apparatus is turned off, as described in connection with the second embodiment, is also applicable to the sixth embodiment.

According to the sixth embodiment as described above, the same advantages as in the fifth embodiment are provided and moreover the elimination of need of the density sensor results in a reduction in cost.

<Seventh Embodiment>

Figure 16:
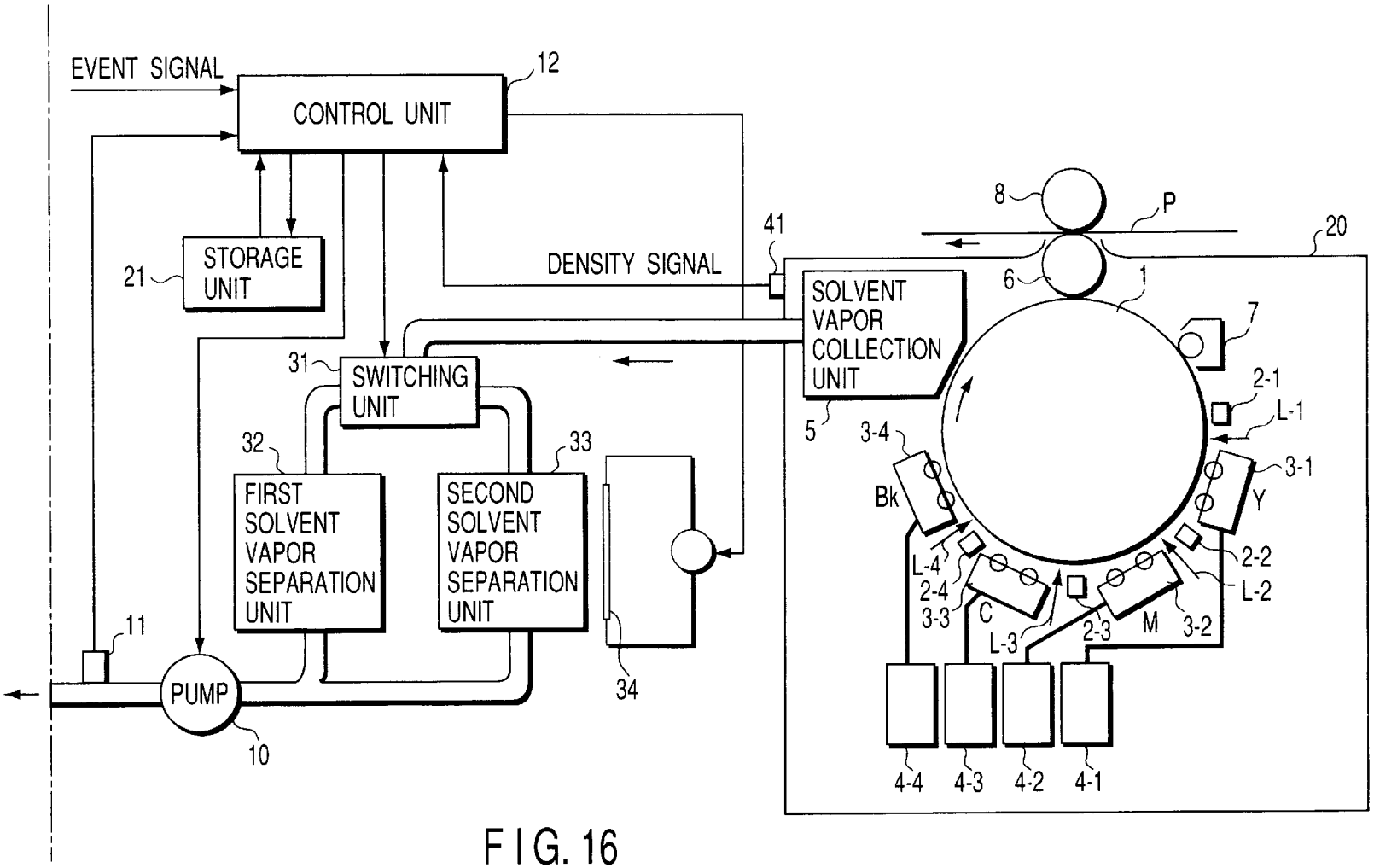
FIG. 16 is a schematic representation of an image formation apparatus according to a seventh embodiment of the present invention.

FIG. 16 shows the configuration of an image formation apparatus according to a seventh embodiment of the present invention.

In FIG. 16, like reference numerals are used to denote corresponding components to those in the fifth shown in FIG. 12 and detailed descriptions thereof are omitted. The differences of the seventh embodiment from the fifth embodiment will be described mainly.

The seventh embodiment is characterized in that, in the event of paper jam, toner exchange, paper supply, or other maintenance, the solvent vapor density within the housing 20 is controlled to fall below the allowable level before the housing 20 is opened.

A density sensor 41 shown in FIG. 16 is adapted to measure the density of solvent vapor within the housing 20. The measurement is sent to the control unit 12. Upon detecting a signal indicating an event of paper jam, toner exchange, paper supply or other maintenance, the control unit 12 controls the density of solvent vapor within the housing 20 to fall below the allowable level before the housing is opened. At this point, the control unit causes the second separation unit 33 to separate and recover the solvent vapor. In this case, to reduce the time required to recover the solvent vapor, it is desirable to use quick-acting activated charcoal or silica gel in the second separation unit 33.

Figure 17:
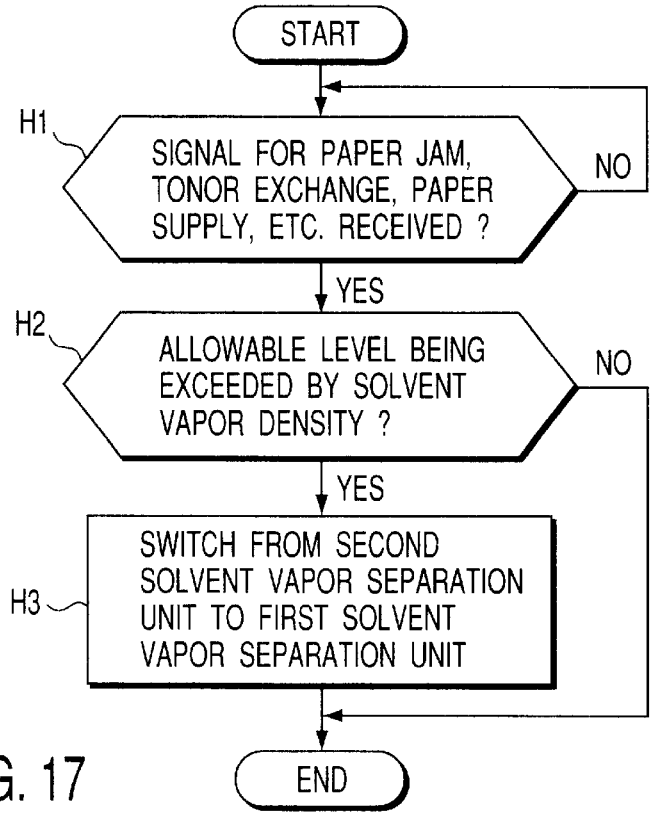
FIG. 17 is a flowchart illustrating the operation of the apparatus of FIG. 16.

Next, the operation of the seventh embodiment will be described using a flowchart of FIG. 17.

Upon detecting a signal indicating an event of paper jam, toner exchange, or paper supply (step Hi), the control unit 12 makes a decision of whether or not the level of the solvent vapor measured by the sensor 41 is above a preset allowable value (critical value) (step H2). If NOT, the separation and recovery of the solvent vapor by the first unit 32 is continued. If YES, on the other hand, the control unit instructs the switching unit 31 to introduce the gas containing the solvent vapor from the collection unit 5 into the second separation unit 33 (step H3).

Thereby, the gas is allowed to flow into the second separation unit 33 where the solvent vapor is separated and recovered. Thus, the density of the solvent vapor within the housing will have fallen below the allowable level by the time when the housing is opened.

According to the seventh embodiment as described above, the same advantages as in the fifth embodiment are provided. Moreover, in the event of paper jam, toner exchange, paper supply or other maintenance, the solvent vapor is separated and recovered by the quick-acting second separation unit 33 when the solvent vapor density within the housing is above the allowable level. Therefore, the density of the solvent vapor within the housing will have fallen below the allowable level by the time when the housing is opened, allowing the safety to be further improved.

<Eighth Embodiment>

Figure 18:
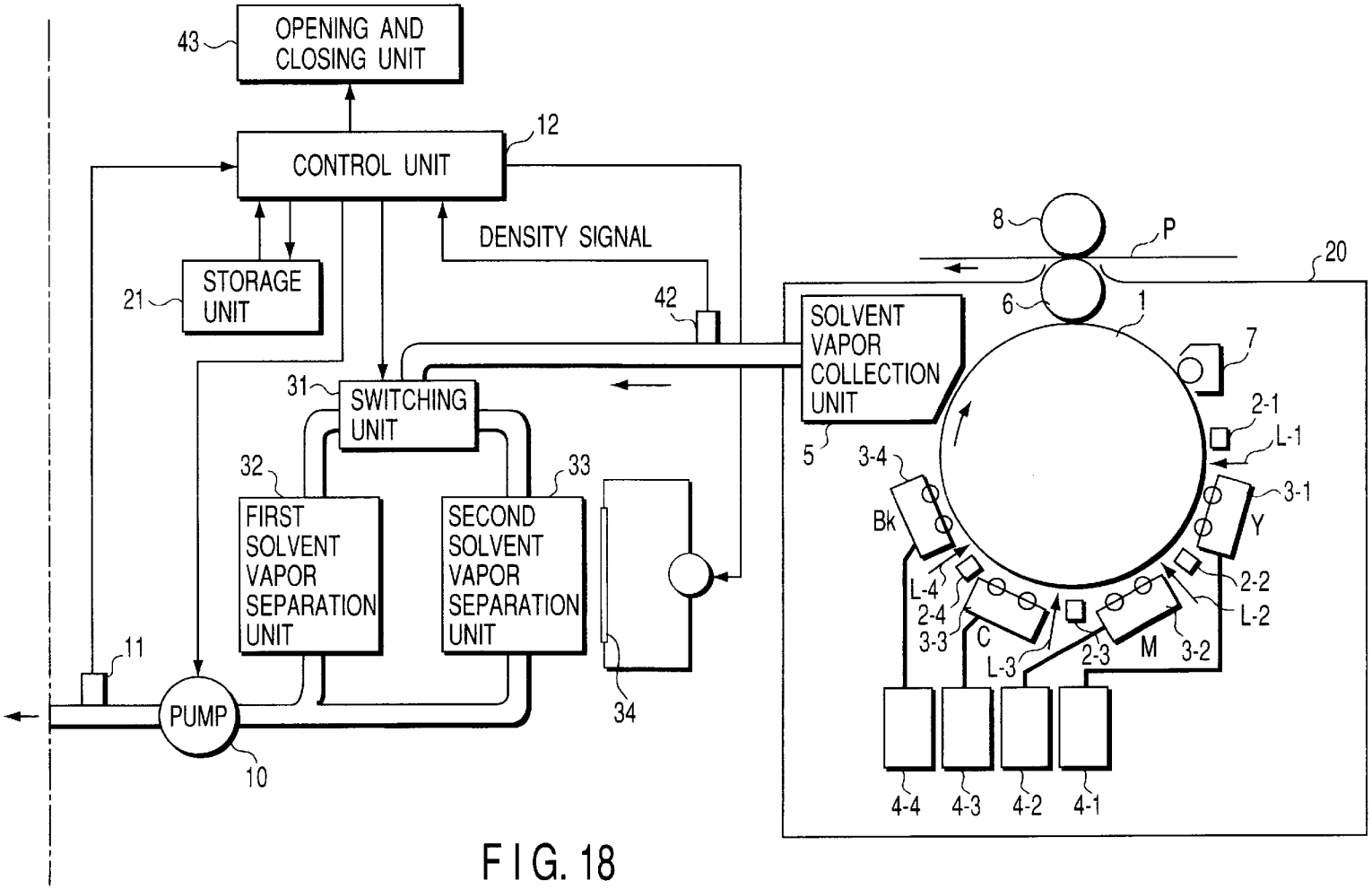
FIG. 18 is a schematic representation of an image formation apparatus according to an eighth embodiment of the present invention.

FIG. 18 shows the configuration of an image formation apparatus according to an eighth embodiment of the present invention.

In FIG. 18, like reference numerals are used to denote corresponding components to those in the fifth shown in FIG. 12 and detailed descriptions thereof are omitted. The differences of the eighth embodiment from the fifth embodiment will be described mainly.

The eighth embodiment is characterized in that, if the density of solvent vapor collected by the vapor collection unit 5 is above the allowable level, the housing 20 is kept closed until the solvent vapor density has fallen below the allowable level.

As shown in FIG. 18, a density sensor 42 is installed in the pipe between the vapor collection unit 5 and the switching unit 31 to measure the solvent vapor density in a gas flowing through the pipe. The measurement is sent to the control unit 12.

An opening and closing unit 43, which is a mechanical key or electromagnet-based electrical key provided in the housing 20, responds to a signal from the control unit to lock or unlock the door of the housing.

Figure 19:
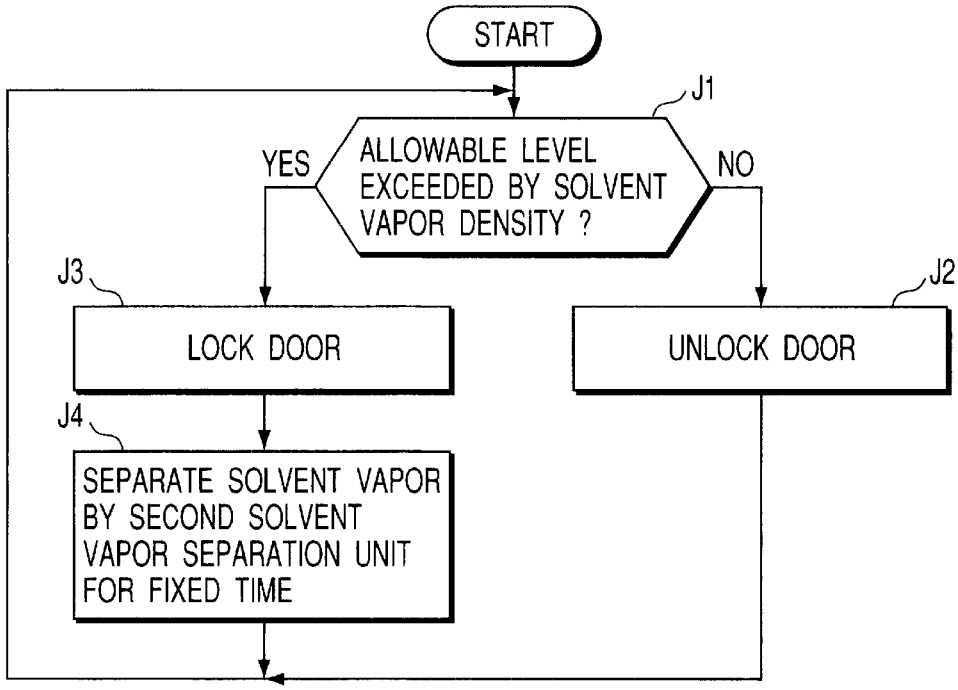
FIG. 19 is a flowchart illustrating the operation of the apparatus of FIG. 18.

The operation of the eighth embodiment will be described using a flowchart of FIG. 19.

The control unit 12 makes a decision of whether or not the vapor density measured by the sensor 42 is above the allowable level (step J1). If the density is not above the allowable level, then the control unit 12 instructs the opening and closing unit 43 to unlock the door of the apparatus body or housing (step J2). Thus, the user can open the door of the apparatus body or housing to carry out work of removing a paper jam, supplementing/exchanging the toner, exchanging the solvent vapor separation units 32 and 33, or the like.

If, on the other hand, the density is above the allowable level, then the control unit 12 instructs the device 43 to disable the apparatus body or housing from being opened (step J3). Thereby, the door of the housing 20 is locked by the device 43, disabling the user for opening the door.

After that, the solvent vapor is separated and recovered by the second vapor separation unit 33 for a fixed time (step J4). The procedure then returns to step J1.

In this manner, the opening and closing unit 43 locks the housing door until the vapor density has fallen below the allowable level and unlocks the housing door after the vapor density has fallen below the allowable level.

Instead of providing the density sensor 42 in the pipe, it may be provided within the housing 20 like the sensor 41 in the seventh embodiment of FIG. 16.

In addition, provision may be made for informing the user of whether the apparatus body or housing is locked or unlocked and the waiting time for the apparatus body or housing being unlocked in a visual or audible manner.

According to the eighth embodiment as described above, the same advantages as in the fifth embodiment are provided. Moreover, the apparatus body or housing is automatically disabled from being opened until the solvent vapor has been recovered by the separation unit 33, that is, until the solvent vapor level measured by the sensor has fallen below the allowable level. Therefore, high-density solvent vapor is kept from escaping to the outside, allowing the safety to be further increased.

The present invention need not be limited to the above embodiments and may be practiced in various modified forms. For example, the embodiments may be used in combination.

Although the solvent vapor separation units in the respective embodiments have been described as recovering the solvent vapor by cooling liquefaction, any other means may be used as long as it can recover the solvent vapor. Activated charcoal or silica gel, if used in the vapor separation unit, is easy to exchange.

In addition, a visible image on the sensitized drum may be directly transferred and fixed to paper without using the intermediate transfer roller, if possible.

Moreover, a visible image may be obtained in a selected color only.

Furthermore, the drum and others controlled by the control unit in the first and second embodiments need not be set to rotate in two speeds; they may be set to rotate in three or more speeds according to the density of solvent vapor or the number of pages to be printed per unit time.

Further, the density sensor may be installed in any place between the inside of the housing and the exhaust port of the apparatus as long as the vapor density can be measured. Two or more sensors may be provided in order to further increase the safety.

According to the present invention, as described above in detail, it is possible to efficiently suppress the discharge of high-density solvent vapor from the apparatus.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. An image formation apparatus comprising:

a latent image carrier which is rotatable;

a developing unit which supplies a liquid developer to the latent image carrier and develops a latent image formed on the latent image carrier, the liquid developer containing solvent and toner particles;

a collecting unit which collects solvent vapor of the liquid developer;

a separating unit which separates the solvent vapor from air collected by the collecting unit;

a sensor which measures a density of solvent vapor in the separating unit; and a control unit which controls a rotational speed of the latent image carrier in accordance with the density of solvent vapor measured by the sensor.

2. The apparatus according to claim 1, further comprising:

an intermediate transfer medium disposed adjacent to the latent image carrier at a first transfer station, the control unit configured to control rotational speed of the intermediate transfer medium in accordance with the density of solvent vapor.

3. The apparatus according to claim 1, wherein:

the developing unit includes a rotatable member having the liquid developer thereon;

a rotational speed of the rotatable member is controlled by the control unit in accordance with the density of solvent vapor.

4. An image formation apparatus comprising:

a latent image carrier which is rotatable;

a developing unit which supplies a liquid developer to the latent image carrier and develops a latent image formed on the latent image carrier, the liquid developer including solvent and toner particles;

a collecting unit which collects solvent vapor of the liquid developer;

a separating unit which separates the solvent vapor from air collected by the collecting unit; and a control unit which controls a rotational speed of the latent image carrier on the basis of a number of pages to be printed per unit time, wherein the control unit determines an operating period of the separating unit after power to the apparatus has been turned off on the basis of the number of pages to be printed per unit time.

5. An image formation apparatus comprising:

a latent image carrier which is rotatable;

a developing unit which supplies a liquid developer to the latent image carrier and develops a latent image formed on the latent image carrier, the liquid developer containing solvent and toner particles;

a collecting unit which collects solvent vapor of the liquid developer;

first and second separating units which separate the solvent vapor from air collected by the collecting unit, the first and second separating units differing in their amount of solvent vapor to be separated per unit time;

a control unit which selects one of the first and second separating units in accordance with variation of an amount of solvent vapor in one of the first and second separating units; and a restoration unit which restores a vapor-separating capacity of one of the first and second separating units, which separates larger amount of solvent vapor per unit time than the other.

6. The apparatus according to claim 5, further comprising:

a sensor which measures a density of solvent vapor in one of the first and second separating units, wherein the control unit selects one of the first and second separating units on the basis of a measured result of the sensor.

7. The apparatus according to claim 5, wherein the control unit selects one of the first and second separating units in response to an event signal.

8. The apparatus according to claim 5, wherein the control unit prevents solvent vapor of the developer evaporated from the latent image carrier from being discharged to outside of the apparatus when a density of the solvent vapor collected by the collecting unit is larger than a certain level.

9. An image formation apparatus comprising:

a latent image carrier which is rotatable;

a developing unit which supplies a liquid developer to the latent image carrier and develops a latent image formed on the latent image carrier, the liquid developer containing solvent and toner particles;

a collecting unit which collects solvent vapor of the liquid developer;

first and second separating units which separate the solvent vapor from air collected by the collecting unit, the first and second separating units differing in their amount of solvent vapor to be separated per unit time; and a control unit which selects one of the first and second separating units on the basis of a number of pages to be printed per unit time.

10. The apparatus according to claim 9, wherein the control unit determines an operating period of one of the first and second separating units after power to the apparatus has been turned off on the basis of the number of pages to be printed per unit time.

11. The apparatus according to claim 9, further comprising:

a restoration unit which restores a vapor-separating capacity of one of the first and second separating units, which separates larger amount of solvent vapor per unit time than the other.

12. The apparatus according to claim 9, wherein the control unit selects one of the first and second separating units in response to an event signal.

13. The apparatus according to claim 9, wherein the control unit prevents solvent vapor of the developer evaporated from the latent image carrier from being discharged to outside of the apparatus when a density of the solvent vapor collected by the collecting unit is larger than a certain level.

* * * * *